US005720641A

United States Patent [19]

Hattori

[11] Patent Number: 5,720,641

[45] Date of Patent: Feb. 24, 1998

[54] MANUFACTURE OF FIELD EMISSION EMITTER AND FIELD EMISSION TYPE DEVICE

[75] Inventor: Atsuo Hattori, Hamamatsu, Japan

[73] Assignee: Yamaha Corporation, Japan

[21] Appl. No.: 685,088

[22] Filed: Jul. 23, 1996

[30] Foreign Application Priority Data

| | | | |
|---|---|---|---|
| Jul. 26, 1995 | [JP] | Japan | 7-209922 |
| Aug. 25, 1995 | [JP] | Japan | 7-240724 |
| Jun. 24, 1996 | [JP] | Japan | 8-163313 |

[51] Int. Cl.[6] ..... H01J 1/30; H01J 9/02

[52] U.S. Cl. ..... 445/50; 445/24

[58] Field of Search ..... 445/24, 50

[56] References Cited

U.S. PATENT DOCUMENTS

| | | | |
|---|---|---|---|
| 5,100,355 | 3/1992 | Marcus et al. | 445/24 |
| 5,141,459 | 8/1992 | Zimmerman | 445/24 |
| 5,203,731 | 4/1993 | Zimmerman | 445/24 |
| 5,334,908 | 8/1994 | Zimmerman | 313/336 |
| 5,599,749 | 2/1997 | Hattori | 445/24 |
| 5,603,649 | 2/1997 | Zimmerman | 445/24 |
| 5,643,032 | 7/1997 | Cheng et al. | 445/50 |

*Primary Examiner*—P. Austin Bradley
*Assistant Examiner*—Jeffrey T. Knapp
*Attorney, Agent, or Firm*—Ostrolenk, Faber, Gerb & Soffen, LLP

[57] ABSTRACT

A recess having a vertical side wall is formed in a silicon substrate, and a first sacrificial film is deposited on the surface of the silicon substrate and etched to form a side spacer on the side wall of the recess. A second sacrificial film is deposited over the substrate surface and oxidized to form an oxide film on the surface of the second sacrificial film, this oxide film serving as a cathode mold die. A cathode conductive film is deposited and selectively etched to form a field emission cathode.

11 Claims, 25 Drawing Sheets

MANUFACTURE OF FIELD EMISSION EMITTER AND FIELD EMISSION TYPE DEVICE

BACKGROUND OF THE INVENTION a) Field of the Invention

The present invention relates to a method of manufacturing a field emission emitter and a field emission type device, and more particularly to a method of manufacturing a field emission emitter and a field emission type device, having a small radius of curvature and a small apex angle of a tip of the emitter.

b) Description of the Related Art

Vacuum microdevice technology has recently drawn attention by which fine cold cathodes for emitting electrons are formed using fine processing techniques of semiconductor integrated circuits and are used with ultra-micro amplifier elements, integrated circuits, flat displays, and the like. For practical applications of vacuum microdevices, it is essential to develop a cold cathode which can stably emit electrons at a low voltage. Cold cathodes are mainly classified into two types, one being a field emission type of emitting electrons from a sharp cathode upon electric field concentration and the other being a type of generating high energy electrons through avalanche or the like in semiconductor and outputting them to external circuits. The field emission type cold cathode is classified into a vertical cathode having a cusp type sharp tip formed in the direction perpendicular to a substrate surface and a lateral cathode having a tip formed horizontally along the substrate surface.

In order to form a vertical type field emission cathode, it is necessary to form a cathode mold die having a sharp tip. The method of forming a cathode mold die is mainly classified into (1) a method using deposition of a sacrificial film, (2) a method using a film and processing it, and (3) a method using anisotropic etching.

FIGS. 19A to 19C are diagrams illustrating a method of manufacturing a field emission cathode by using a sacrificial film. With this method, a recess 102 having a vertical side wall is formed in the substrate 101 (FIG. 19A), and after a sacrificial film 103 is deposited on the substrate 101 through deposition having good step coverage, a cathode material film 104 is deposited (FIG. 19B), and the substrate 101 and sacrificial film 103 are removed to form a field emission cathode 104 (FIG. 19C).

FIGS. 20A to 20F are diagrams illustrating a method of manufacturing a field emission cathode by using a film and processing it. With this method, a silicon oxide film 111, a gate film 112, and a silicon nitride film 113 are formed on a silicon substrate 110 and a recess 115 is formed by using a resist pattern 114 (FIG. 20A), after the resist pattern 114 is removed, a silicon oxide film 116 and a silicon film 117 are laminated (FIG. 20B), the silicon film 117 is fully oxidized to form a silicon oxide film 118 (FIG. 20C), after unnecessary portions of the silicon oxide films 116 and 118 are removed to form silicon oxide films 119 and 120, a conductive film is deposited and patterned to form a cathode 121 (FIG. 20D), and thereafter the unnecessary silicon oxide films 119 and 120 on the tip side of the cathode 121 is etched and removed to form a field emission cathode (FIG. 20E).

FIGS. 21A to 21D are diagrams illustrating a method of manufacturing a field emission cathode by using anisotropic etching. With this method, an etching mask 131 is formed on a crystal substrate 130 (FIG. 21A), a recess 133 is formed in the substrate 130 by anisotropic etching to form a substrate 132 with the recess 133 (FIG. 21B), a cathode material film 134 is deposited (FIG. 21C), and the unnecessary etching mask 131 and substrate 132 are etched to form a field emission cathode 134 (FIG. 21D).

The conventional methods of manufacturing a field emission cathode have the following problems. With the methods (1) and (2), if a sacrificial film 141 is deposited on the recess of the substrate 140 through deposition having poor step coverage, as shown in FIG. 22A the sacrificial film 141 deposited on the recess has a reverse tape structure (overhung structure) with the projecting A portion and a B portion having a small radius of curvature.

FIG. 22B shows a sacrificial film 142 formed thick on the substrate 140, or formed by oxidizing or nitriding a deposited sacrificial film. As shown in FIG. 22C, if a cathode material film 143 is deposited by using the sacrificial film 142 as the cathode mold die, the conductive cathode material film 143 has a broadened tip C so that an electric field is hard to be concentrated on this tip and the directivity of emitted electrons becomes degraded. Furthermore, a void is formed in the tip C of the cathode 143 so that the mechanical strength of the cathode 143 is lowered.

FIGS. 23A and 23B show sacrificial films 145 and 146 formed through deposition or reaction thicker than those shown in FIGS. 22B and 22C. As shown in FIG. 23A, the side wall of the sacrificial film 145 disappears in the recess and a mold die having a relatively small apex angle can be formed at D. However, the position D of the tip is remote from the bottom of the recess of the substrate 140. In this state, a cathode conductive material film 147 is deposited as shown in FIG. 23B, a distance between the tip of the cathode 147 and the bottom of the recess of the substrate 140 is long. The distance between the gate formed by these methods (1) and (2) and the tip of the cathode 147 is also long so that a drive voltage of the device becomes high.

Further, as seen from FIGS. 22C and 23B, with the methods (1) and (2), the cathode tip is either near to the recess bottom (FIG. 22C) or very remote from the recess bottom (FIG. 23B). The disadvantage is therefore a low degree of design freedom that a field emission cathode cannot be formed at a desired height. Furthermore, even if the tip of the cathode 147 is intended to be formed remote from the recess bottom as shown in FIG. 23B, the tip of the cathode 143 is formed near to the recess bottom as shown in FIG. 22C if the thickness of the sacrificial film 146 is insufficient or if the degree of oxidizing or nitriding is insufficient. The disadvantage is therefore a low process margin.

As shown in FIG. 24A if a sacrificial film 151 is deposited on the recess of the substrate 140 having a vertical side wall through deposition having good step coverage, although an overhung structure is not formed, the radius of curvature at the end portion E becomes large. If as shown in FIG. 24B the sacrificial film 152 is made thick through deposition or reaction, although a mold F with a small radius of curvature is obtained as the mold die, the distance between a tip of the cathode 153 and the recess bottom of the substrate 140 becomes long as shown in FIG. 24C after a cathode conductive material film 153 is deposited. Therefore, the distance between the gate formed by these methods (1) and (2) and the tip of the cathode is also long so that a drive voltage of the device becomes high.

Next, with the method (3) using anisotropic etching, a formed recess is a cone having a square dross section, and the apex angle of the recess is determined depending upon the angle of the crystal surface of the substrate. Therefore, if the recess formed by anisotropic etching is used as the cathode mold die, a cathode having a small apex angle cannot be formed. With a cathode of a cone having a square cross section, stable current emission characteristics cannot be obtained. Substrates capable of anisotropic etching are limited only to single crystal silicon substrates and GaAs substrates having the (100) surface, and the etching is limited to wet etching. Therefore, a degree of design freedom is small and fine devices are difficult to be manufactured.

SUMMARY OF THE INVENTION

An object of the present invention is to provide a method of manufacturing a field emission cathode and a field emission type device capable of forming a cathode having a small aspect angle and a small radius of curvature of the cathode tip.

According to one aspect of the present invention, there is provided a method of manufacturing a field emission cathode, comprising the steps of: forming a recess having a vertical or generally a vertical side wall in a substrate; depositing a first sacrificial film on the substrate with the recess being formed; forming a side spacer on the recess by etching the first sacrificial film; depositing a second sacrificial film on the substrate having the recess formed with the side spacer; forming an oxide film or nitride film by oxidizing or nitriding the second sacrificial film; depositing a field emission cathode electrode material film on the oxide film or nitride film; and removing at least part of the oxide film or nitride film under the field emission cathode electrode material film to expose at least a tip of the field emission cathode electrode material film.

According to another aspect of the present invention, there is provided a method of manufacturing a field emission type element, comprising the steps of: forming a recess having a vertical or generally a vertical side wall in a substrate; depositing a sacrificial film on the substrate with the recess being formed; forming a side spacer on the recess by etching the sacrificial film; depositing a gate electrode conductive film on the substrate having the recess formed with the side spacer; forming an oxide film or nitride film by oxidizing or nitriding the surface of the conductive film; depositing a field emission cathode electrode material film on the oxide film or nitride film; and removing the oxide film or nitride film around a tip of the field emission cathode electrode material film to expose the tip thereof.

The side spacer formed on the vertical or generally the vertical recess provides a gentle slope on the side wall of the recess. Over this recess formed with the side spacer having a gentle slope, a sacrificial film or conductive film is formed. Therefore, the sacrificial film or conductive film does not form a reverse taper but it necessarily forms an ordinary taper, even with any film deposition method. Since the ordinary taper is retained after this sacrificial film or conductive film is oxidized or nittided, a cusp with a small apex angle is formed on the surface of the oxide film or nitride film.

Furthermore, since the volume of the recess is reduced by forming the side spacer, a recess having a small radius of curvature is formed on the surface of the sacrificial film or conductive film, even with any film deposition method. After this sacrificial film or conductive film is oxidized or nitrided, the radius of curvature is further reduced. Accordingly, a cathode mold die of a downward cusp having a small radius of curvature and a small apex angle can be formed. By using this die, a field emission cathode having a tip with a small radius of curvature and a small apex angle can be obtained, and a field emission type device with such a cathode can be obtained.

Still further, the sacrificial film or conductive film can be deposited by poor step coverage methods so that the radius of curvature of the cusp and hence the cathode tip can be made smaller. The radius of curvature of this cusp of the sacrificial film or conductive film can be made smaller by oxidizing or nitriding it.

The surface shape of the sacrificial film or conductive film has always an ordinary taper regardless of its thickness or the amount of later process reaction, so that the thickness and the amount of process reaction can be selected as desired. By controlling the thickness and the amount of process reaction, the position of the cusp as the cathode mold die can be set as desired. Accordingly, the position of the tip of a field emission cathode can be precisely determined. In manufacturing a field emission cathode, the position of the tip can be set at a desired height, and in manufacturing a field emission type device with a gate electrode, the distance between the field emission cathode and gate can be easily set to satisfy the optimum relationship for the maximum electric field intensity.

After the gate electrode conductive film is deposited on the substrate having a recess with a side spacer, the conductive film is oxidized or nittided. With these processes, the unreacted conductive film is used as the gate electrode and the reacted conductive film is used as the cathode mold die. Therefore, both the gate electrode and cathode mold die can be formed by using only one film forming process. The reacted conductive film becomes an insulating film electrically isolating the cathode from other regions.

The insulating film formed by oxidizing or nitriding has a higher dielectric breakdown voltage than an insulating film formed by CVD, sputtering, vapor deposition, or the like. Therefore, the reliability of a field emission cathode can be improved. Furthermore, since the number of film deposition processes is small, manufacture throughput of field emission cathodes can be improved.

DETAILED DESCRIPTION OF THE PREFERRED EMBODIMENTS

Figure 1A:
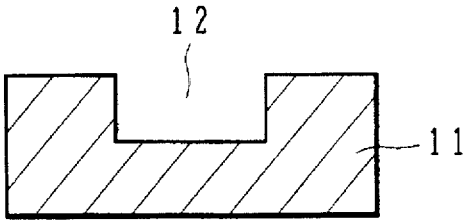
FIGS. 1A to 1G illustrate the processes of manufacturing a field emission cathode according to an embodiment of the invention.

FIGS. 1A to 1G are cross sectional views illustrating a fundamental manufacture method according to an embodiment of the invention. As shown in FIG. 1A, a silicon substrate is prepared as a starting substrate 11. On the substrate, an unrepresented resist pattern is formed. By using the resist pattern as an etching mask, the substrate 11 is etched through reactive ion etching to form a recess 12 having generally the vertical side wall. The size of the recess 12 is about 0.5 μm in diameter and about 0.3 μm in depth. The side wall of the recess has an angle in the range of 90°+/−15° relative to the starting substrate 11. The reactive ion (dry) etching is conducted by a magnetron reactive ion etcher under the following conditions:

gas: $HBr+Cl_2$ total pressure: 125 mTorr flow rate of HBr and $Cl_2$: 12/27 sccm RF power: 400 W magnetic flux: 55 Gauss The etching may be conducted by a wet etching instead of the dry etching.

Figure 1B:
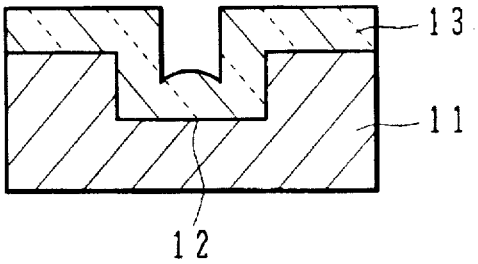

Next, as shown in FIG. 1B, on the substrate 11 with the recess 12, a silicone oxide film 13 as a first sacrificial film is formed to a thickness of about 0.2 μm by atmospheric pressure chemical vapor deposition (CVD). The film forming conditions are, for example, a source gas of $O_3$ and tetraethoxyorthosilicate (TEOS) and a substrate temperature of 400° C. The surface of the first sacrificial film 13 has a shape conformal to the shape of the lower recess 12.

Figure 1C:
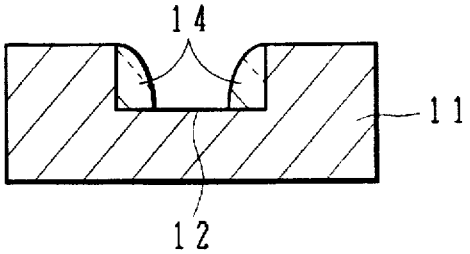

Next, as shown in FIG. 1C, the sacrificial film 13 is etched back to leave the sacrificial film 13 only at the side wall of the recess 12 as a side spacer 14. The side spacer 14 sharpens the cusp of a cathode mold die constituted by the surface of a second sacrificial film to be later formed. The etch-back uses anisotropic dry etching. For example, in a magnetron RIE system, the sacrificial film 13 is etched back at a reaction chamber pressure of 50 mTorr and with an etching gas of $CHF_3+CO_2+Ar+He$. This side spacer 14 provides the recess 12 with a smooth side wall and reduces the volume of the recess 12.

Figure 1D:
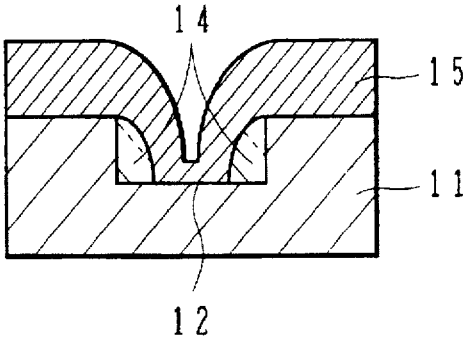

Next, as shown in FIG. 1D, an amorphous silicon film 15 as a second sacrificial film is sputtered to a thickness of 0.1 μm. This sputtering of the amorphous silicon film 15 is performed, for example, in a DC sputtering system using a polycrystalline silicone target.

Figure 1E:
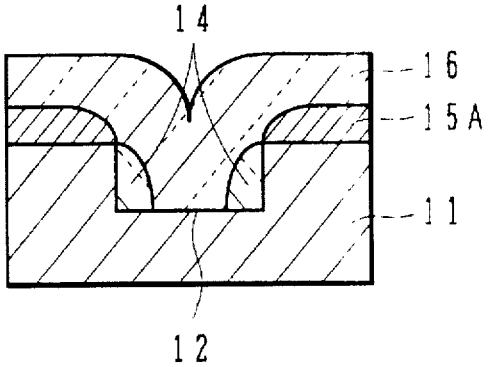

Next, as shown in FIG. 1E, the second sacrificial film 15 is partially oxidized by wet oxidation to form a silicon oxide film 16 on the surface region thereof. The region 15A not oxidized is left. Oxidizing the second sacrificial film 15 changes the surface shape so that the shape of a cusp used for the cathode mold die is made deep and sharp. This oxidation is performed, for example, in a vertical furnace in which the substrate is placed, at a furnace temperature of 850° C. and by introducing $H_2$ (30 slm) and $O_2$ (20 slm).

Figure 1F:
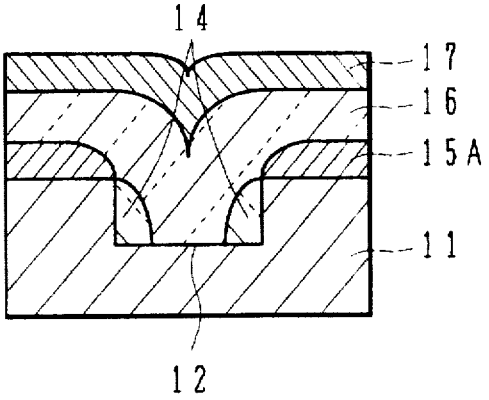

Next, as shown in FIG. 1F, a TiN film as a cathode conductive material (electron emitting material) film 17 is deposited 0.2 μm thick by reactive sputtering. This sputtering is performed in a DC sputtering system by using a Ti target and introducing a gas of $N_2+Ar$.

Figure 1G:
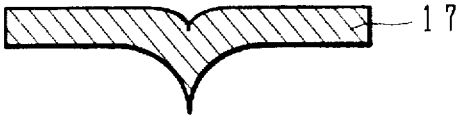

Lastly, the unnecessary substrate 11, sacrificial films 14 and 15A, and oxide film 16 are etched and removed to complete a field emission cathode 17 such as shown in FIG. 1G. $HF+HNO_3+CH_3COOH$ is used for etching the silicon substrate and $HF+NH_4F$ is used for etching the silicon oxide film.

In this embodiment, a field emission cathode having a small radius of curvature and a small apex angle of the tip can be obtained.

The following various modifications of this embodiment are possible.

Since the starting substrate is eventually removed, other optional substrates different from a silicon substrate may be used if a recess can be formed therein. For example, such substrates may be insulating substrates made of glass, quartz, and the like, semiconductor substrates made of Ge, GaAs, and the like, and conductive substrates made of Al, Cu, Ti, Mo, TiN, TiW, WSi, and the like.

Figure 2A:
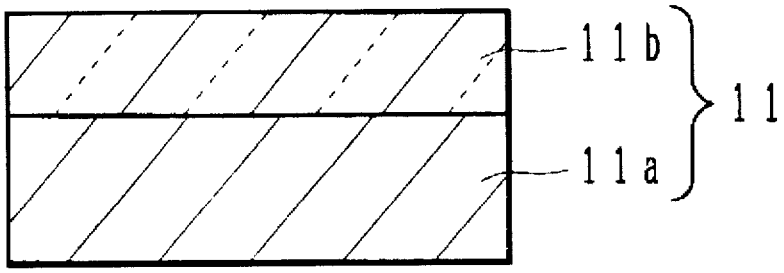
FIGS. 2A and 2B show a starting substrate and illustrate a process of forming a recess according to another embodiment.
Figure 2B:
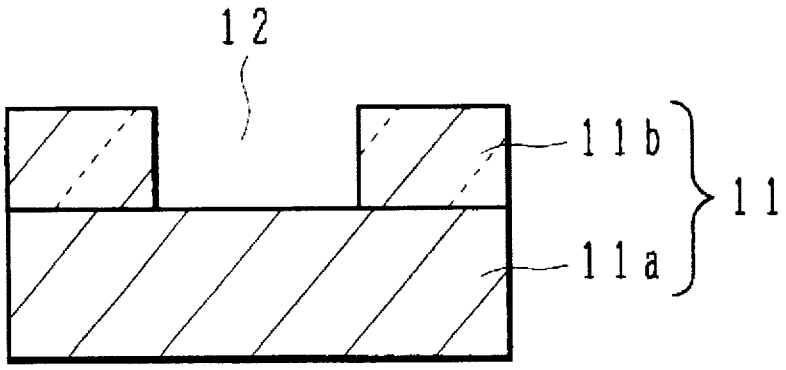

The starting substrate 11 is not limited to a single layer substrate, but a laminate substrate may be used. For example, as shown in FIG. 2A, the laminate substrate may be a silicon substrate 11*a* and a silicon oxide film 11*b* stacked thereon. In this case, as shown in FIG. 2B, a recess 12 can be formed by etching the silicon oxide film 11*b*. By using the laminated substrate having a different etching rate from that of an underlying film, this film functions as an etching stopper so that the depth of the recess 12 can be controlled precisely.

The two-layer laminated substrate may be, in addition to a silicon substrate formed with a silicon oxide film, a silicon substrate formed with a silicon oxynitride film, and a glass substrate formed with a polycrystalline silicon film. A multi-layer substrate having three or more layers may be used. For example, such a multi-layer substrate may include a silicon substrate formed with a silicon nitride film and a silicon oxide film formed on the silicon nitride film, and a glass substrate formed with a polycrystalline silicon film and a TiN film formed on the polycrystalline silicon film.

The recess may be formed without using a resist pattern, through a laser beam process or an ion beam process.

The first sacrificial film 13 shown in FIG. 1B may be a silicon oxide film formed by low pressure CVD using $O_2$+$SiH_4$ as a source gas, a silicon nitride film formed by low pressure CVD using $N_2$+$SiH_4$ as a source gas, a silicon oxynitride film formed by photo assisted CVD using $N_2O$+$SiH_4$ as a source gas, a silicon nitride film formed by photo assisted CVD using $N_2$ (or $NH_3$)+$SiH_4$ as a source gas, or other substrates.

The second sacrificial film 15 shown in FIG. 1D may use, in addition to amorphous silicon, a polycrystalline silicon film formed by low pressure CVD, an Al film, a Ta film, an Hf film, or the like formed by sputtering.

If the second sacrificial film 15 is made of amorphous silicon or polycrystalline silicon, the oxidation of this film may be, in addition to wet oxidation, dry oxidation, vapor oxidation, pressure oxidation, plasma oxidation, and the like. If the second sacrificial film 15 is made of Al, Ta, Hf, or the like, the oxidizing method for this film may be thermal oxidation, anodic oxidation, and the like. Instead of oxidizing, nitriding may be used. The nitriding method may by thermal nitriding, nitrogen nitriding, ammonium nitriding, ammonium plasma nitriding, and the like.

If the second sacrificial film 15 is made of a Ta film, this film may be oxidized by anodic oxidation, thermal oxidation, or the like to form the cathode mold die.

Figure 3A:
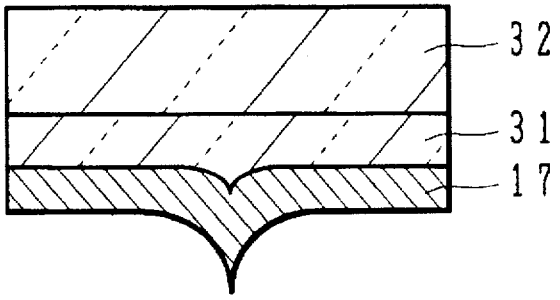
FIGS. 3A to 3C show a cathode support structure of another embodiment.
Figure 3B:
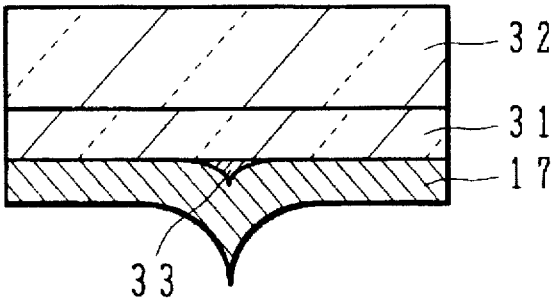

In order to ensure a sufficient mechanical strength of the field emission cathode, it is preferable as shown in FIG. 3A that prior to etching the unnecessary portions, a support substrate 32 is adhered to the cathode conductive film 17 by using adhesive 31 such as epoxy resin, low melting point glass, or the like. The support substrate 32 may be made of, for example, glass, quartz, or $Al_2O_3$. In this case, adhesive may not be filled in a cusp on the back surface of the cathode 17 and therefore a void may be formed. In order to avoid this, as shown in FIG. 3B, a coat film 33 such as SOG is formed and etched back by chemical mechanical polishing (CMP) to planarize the back surface.

Figure 3C:
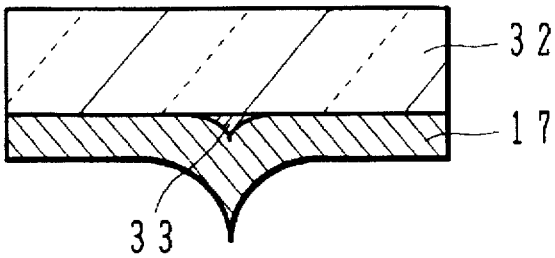

If the back surface of the cathode 17 is planarized, as shown in FIG. 3C the support substrate 31 may be directly adhered by electrostatic bonding or the like. Use of epoxy resin may emit gas therein and lowers the device vacuum degree, and use of low melting point glass diffuses Pb components or the like therein and may cause short-circuits of wiring layers or other defects. Direct adhesion by electrostatic bonding eliminates such problems.

Figure 4A:
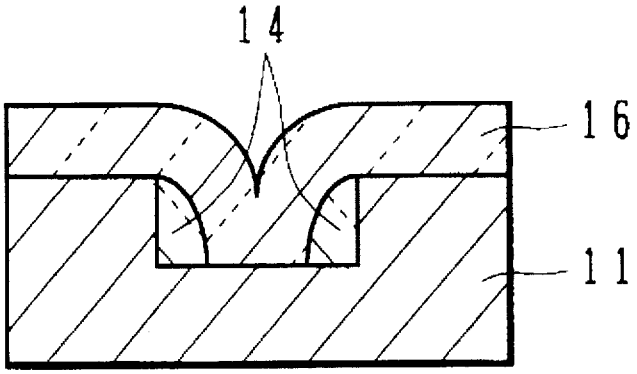
FIGS. 4A and 4B illustrate a process of forming a cathode mold die of another embodiment.
Figure 4B:
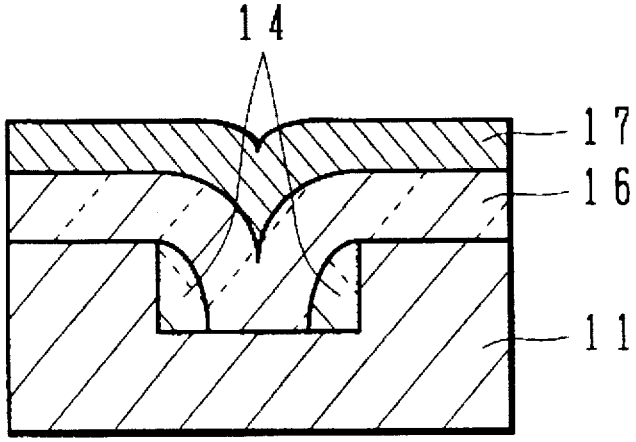

In the processes shown in FIGS. 1D and 1E, the second sacrificial film 15 is partially oxidized. Instead, as illustrated in FIGS. 4A and 4B, the whole of the second sacrificial film 15 is transformed into an oxide film 16 (or nitride film) and thereafter, as shown in FIG. 4B, the cathode conductive film 17 is deposited. The reaction amount of this second sacrificial film 15 may be controlled by a reaction time, a substrate temperature, and the like.

Next, an embodiment of a field emission cathode having a gate electrode will be described with reference to FIGS. 5A to 5G.

Figure 5A:
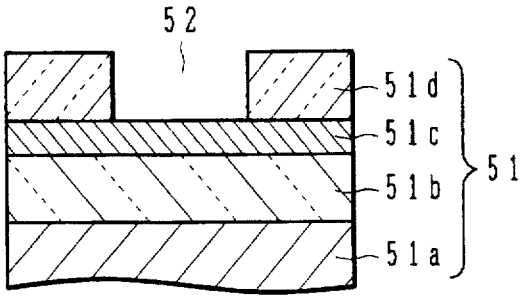
FIGS. 5A to 5G illustrate the processes of manufacturing a field emission type device according to an embodiment of the invention.

As shown in FIG. 5A, a starting substrate 51 is prepared which has a silicon substrate **51*a* (625 μm thick) on which a silicon oxide film 51*b* (0.5 μm thick), a phosphorous or boron doped polycrystalline silicon film 51*c* (0.15 μm thick) and a silicon oxide film 51*d* (0.3 μm thick) are sequentially laminated. The polycrystalline silicon film 51*c*** is used as an anode electrode.

Figure 5B:
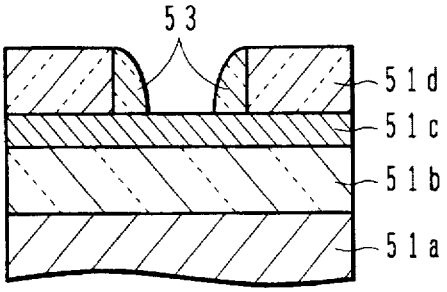
Figure 5C:
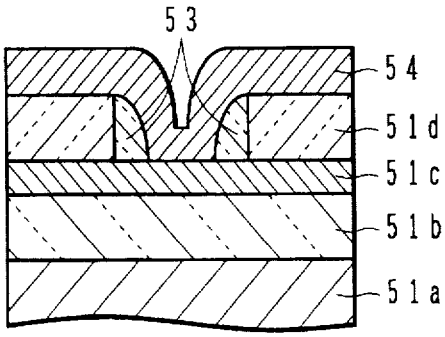

By using a resist mask, the starting substrate 51 is etched to form a recess 52 of 0.5 μm in diameter and 0.3 μm in depth, the recess 52 having generally the vertical side wall. Thereafter, as shown in FIG. 5B, a side spacer 53 is formed on the side wall of the recess 52. The processes up to this process of forming the side spacer 53 are similar to those of the above embodiment, and various modifications are possible like the above embodiment. The side spacer 53 serves as a first sacrificial film. Thereafter, as shown in FIG. 5C, as a gate electrode conductive film 54, a phosphorous or boron diffused amorphous silicon film is deposited about 0.1 μm thick. Specifically, the amorphous silicon film is sputtered in a DC sputtering system using a phosphorous or boron containing polycrystalline silicon target and Ar gas.

Figure 5D:
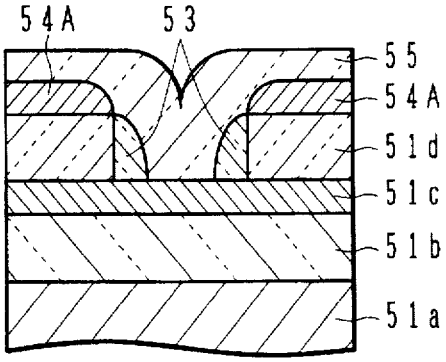

Next, as shown in FIG. 5D, the gate electrode conductive film 54 is partially oxidized by wet oxidation to form a silicon oxide film 55. The region 54A not oxidized is left. This oxidation is performed, for example, in a vertical furnace at a furnace temperature of 850° C. by introducing $H_2$ (30 slm) and $O_2$ (20 slm). In this case, the oxidation time is controlled to leave the unreacted conductive film 54A to a thickness of about 50 nm. The unreacted conductive film 54A becomes the gate electrode, and the oxide film 55 becomes the cathode mold die having cusp shape. The oxide film 55 serves as a second sacrificial film.

Figure 5E:
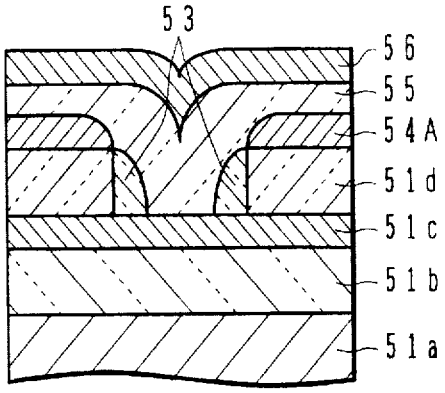

Thereafter, as shown in FIG. 5E, a TiN film as a cathode conductive film 56 is deposited 0.2 μm thick by sputtering. This sputtering is performed, for example, in a DC sputtering system by using a Ti target and introducing a gas of $N_2$+Ar. A tip is formed by the mold of the second sacrificial film 55.

Figure 5F:
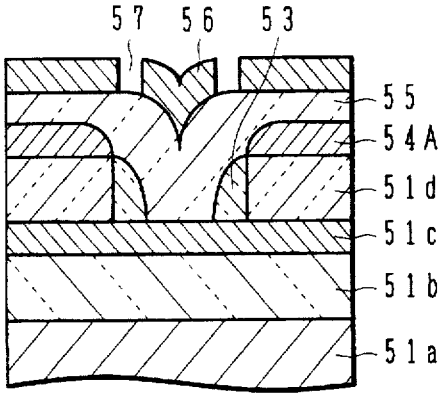

Next, a resist mask is formed on the cathode conductive film 56 by usual photolithography techniques to etch a portion of the cathode conductive film 56 not used as the cathode and to form an opening 57 shown in FIG. 5F. For example, the opening 57 is formed through etching in a magnetron RIE system by using $C_2$ as an etching gas and at a reaction chamber pressure of 125 mTorr.

Figure 5G:
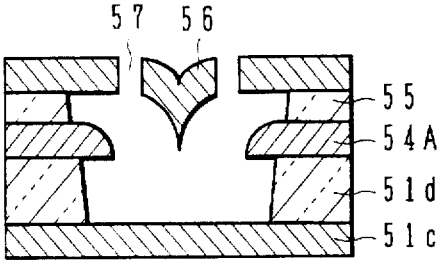

As shown in FIG. 5G, the silicon substrate **51*a* is etched and removed. The oxide film 55 (the second sacrificial film), side spacer 53 (the first sacrificial film) and part of the substrate 51 are etched via the opening 57 by isotropic wet etching to expose the tip of the cathode 56 and complete the field emission type device. Specifically, the silicon substrate 51*a* is etched and removed by using HF+$HNO_3$+$CH_3COOH$ aqueous solution or ethylenediamine+catechol mixed aqueous solution, and the silicon oxide film 55, side spacer 53, and part of the silicon oxide film 51*d*** at the uppermost layer of the substrate are etched and are moved by using HF+$NH_4F$.

Figure 6:
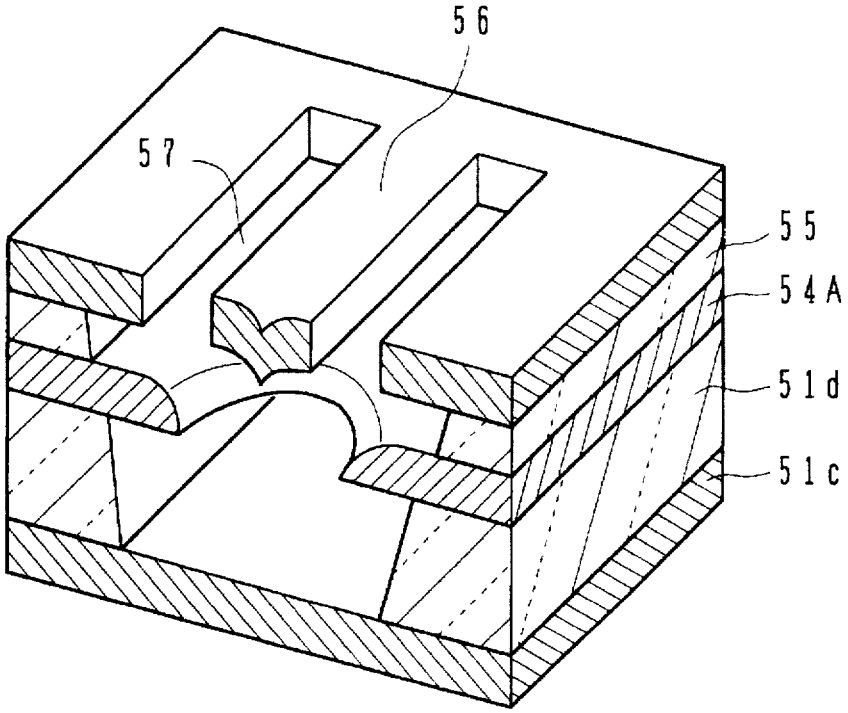
FIG. 6 is a perspective view showing a device manufactured by the embodiment processes illustrated in FIGS. 5A to 5G.

FIG. 6 is a perspective view of a field emission type device manufactured by this embodiment. This triode device is vacuum sealed to form a fine triode vacuum tube.

With this embodiment method, a field emission type device can be manufactured having a high performance field emission cathode 56 self-aligned with a gate electrode 54.

The following various modifications of this embodiment are possible.

Figure 7:
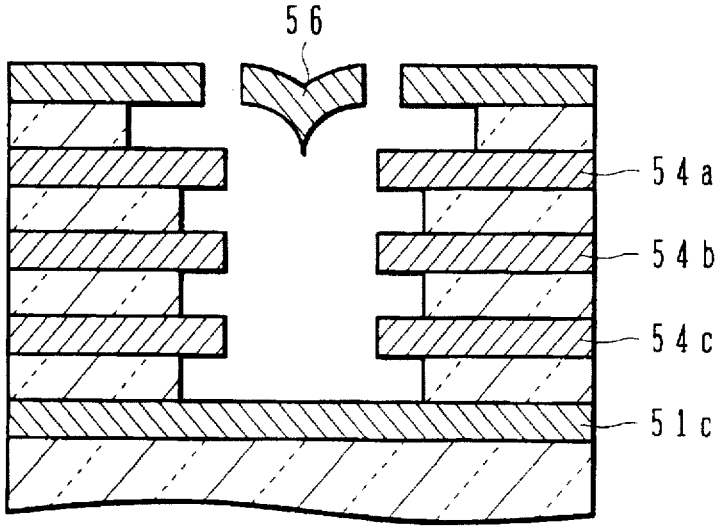
FIG. 7 shows the structure of a field emission type device of another embodiment.

For example, a field emission type device of a multigate structure can be formed by using a starting substrate having a plurality of conductive films and insulating films alternately laminated. FIG. 7 shows a field emission type device of a pentode structure constituted by a cathode 56, an anode 51*c*, and three gate electrodes 54*a*, 54*b*, and 54*c*.

Figure 8A:
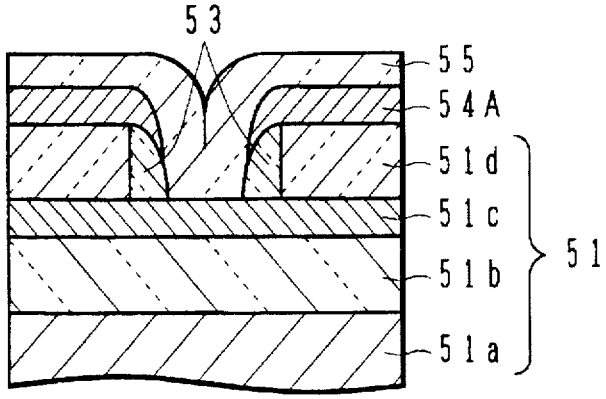
FIGS. 8A to 8C illustrate the processes of manufacturing a field emission type device according to another embodiment of the invention.
Figure 8B:
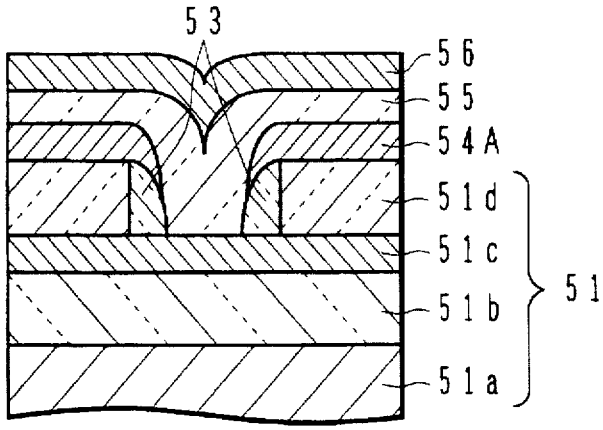
Figure 8C:
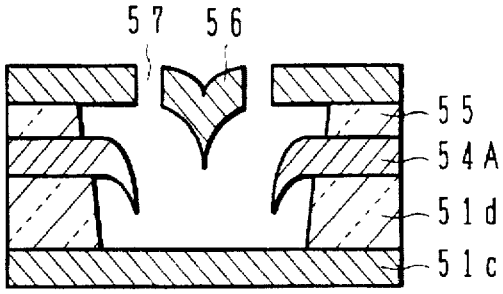

If the amount of oxidation at the oxidizing process illustrated in FIG. 5D is reduced, the left gate electrode conductive film 54A increases as shown in FIG. 8A. Thereafter, similar to the previous embodiment, a cathode conductive film 56 is deposited (FIG. 8B) and the unnecessary portion is etched to complete the device (FIG. 8C). As compared to the previous embodiment, a field emission type device having a gate 54A with a smaller diameter and a cathode 56 with a smaller apex angle can be obtained. The amount of oxidation of the conductive film 54A can be controlled by an oxidizing time and a substrate temperature. The amount of nitriding a nitride film can also be controlled in the same manner.

Figure 9:
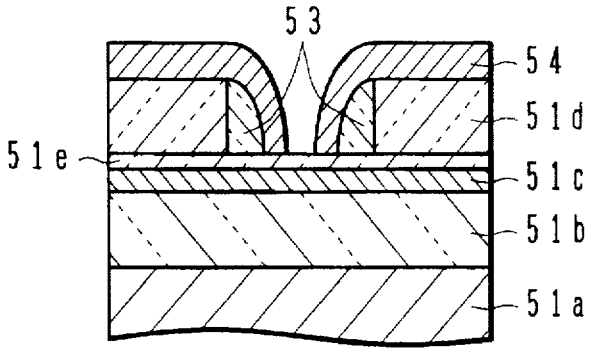
FIG. 9 illustrates the process of manufacturing a field emission type device according to another embodiment of the invention.

If the gate electrode conductive film 54A at the bottom of the recess 52 is not completely oxidized at the processes of FIGS. 5C and 5D, a gate opening of the shape surrounding the cathode cannot be formed. In order to reliably form such a gate opening, a silicon oxide film (or preferably a silicon nitride film) 51*e* is formed on an impurity doped silicon layer 51*c* as shown in FIG. 9, and after the process of FIG. 5C, the conductive film 54 is etched back to exposed the silicon oxide film 51*e* formed on the impurity doped silicon layer 51*c*. The amount of oxidation at the next oxidizing process can therefore be set as desired, for example, smaller. Since the silicon oxide film or silicon nitride film 51*e* prevents oxidation of the impurity doped silicon layer 51*c* and dielectrically isolates the conductive film 54 from the impurity doped silicon layer 51*c*, the gate electrode having a gate hole surrounding the cathode and separated in cross section into two parts by the gate hole, can be easily formed.

Figure 10A:
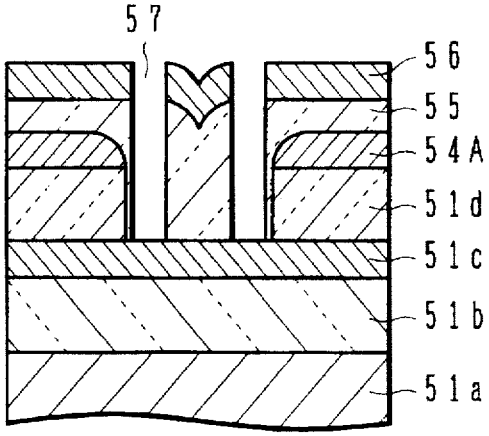
FIGS. 10A and 10B illustrate the processes of manufacturing a field emission type device according to an embodiment of the invention.
Figure 10B:
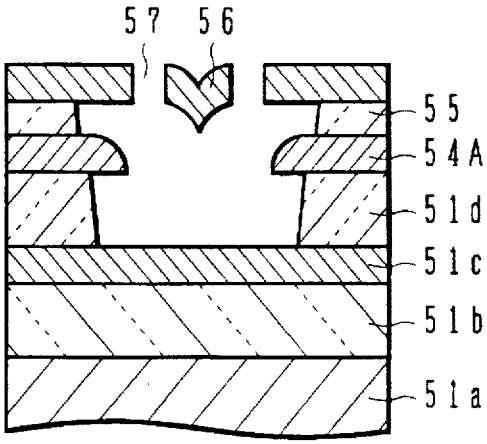

Although isotropic etching is used at the silicon oxide film removing process of FIG. 5G, anisotropic dry etching may be used in combination. For example, as shown in FIG. 10A, after the silicon oxide film just under the opening 57 is vertically etched by RIE, the silicon oxide film under the cathode 56 is etched by isotropic etching as shown in FIG. 10B.

Figure 11:
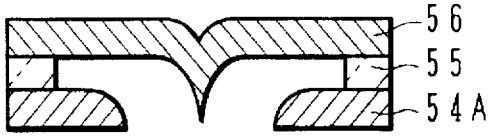
FIG. 11 shows the device structure manufactured by the embodiment processes illustrated in FIGS. 10A and 10B.

After the process shown in FIG. 5E, the silicon substrate 51*a*, silicon oxide film 51*b*, and anode electrode conductive film 51*c* are etched from the starting substrate 51 side, and the side spacer 53 and the oxide film 55 around the tip of the cathode 56 are etched to form a diode device constituted by the cathode 56 and gate electrode 54A as shown in FIG. 11.

For triode device or multi-electrode device, etching may be performed from the substrate side. Such embodiments will be described next.

Figure 12A:
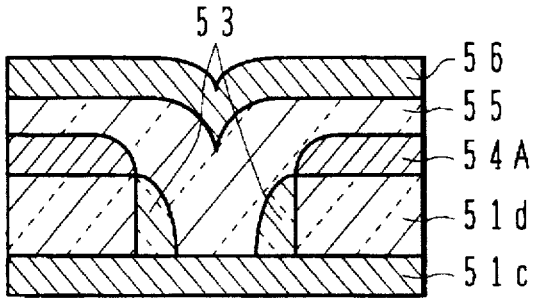
FIGS. 12A to 12C illustrate the processes of manufacturing a field emission type device according to an embodiment of the invention.
Figure 12B:
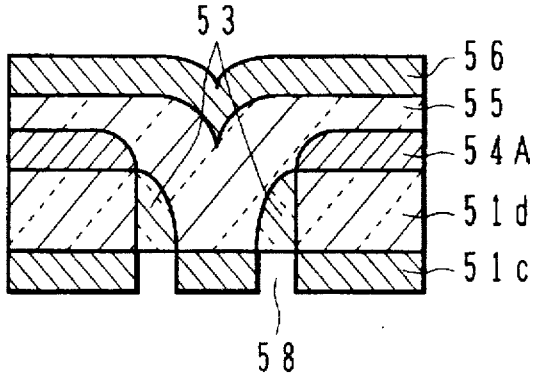
Figure 12C:
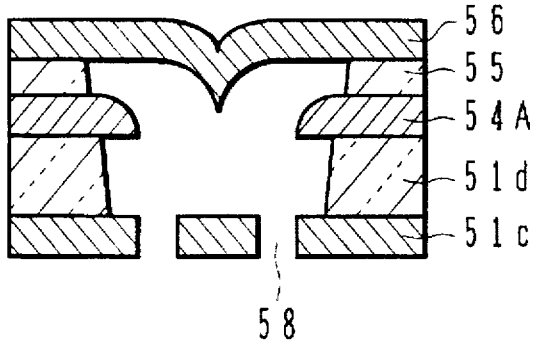

FIGS. 12A to 12C illustrate an embodiment of a method of manufacturing a triode device by etching from the substrate side. After the process of FIG. 5E, the silicon substrate 51*a* is etched and removed by using $HF+HNO_3+CH_3COOH$ aqueous solution or ethylenediamine+catechol mixed aqueous solution, and the silicon oxide film 51*b* is etched by using $HF+NH_4F$ (FIG. 12A). Next, by using an unrepresented resist mask, the polycrystalline silicon film 51*c* is etched to form an opening 58 (FIG. 12B). For example, this etching is performed in a magnetron RIE system at a reaction chamber pressure of 125 mTorr and by using $Cl_2$ as an etching gas. Parts of the silicon oxide films 51*d* and 55, and the side spacer 53 are etched by $HF+NH_4$ to form a triode device constituted by the cathode 56, gate electrode 54A, and anode 51*c* (FIG. 12C).

Figure 13A:
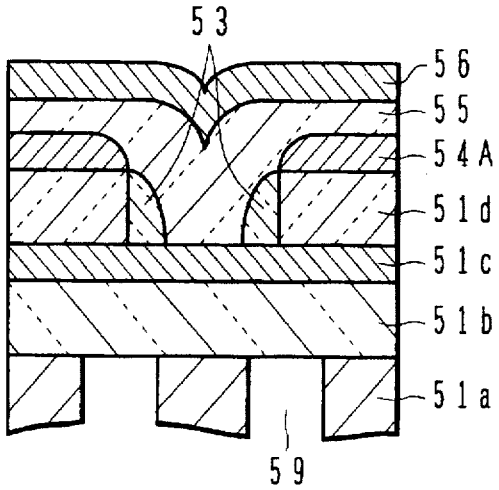
FIGS. 13A to 13D illustrate the processes of manufacturing a field emission type device according to an embodiment of the invention.

FIGS. 13A to 13D illustrate another embodiment of a method of manufacturing a triode device by etching from the substrate side. After the process of FIG. 5E, by using an unrepresented resist mask, the silicon substrate 51*a* is etched to form an opening 59 (FIG. 13A). This etching is performed, for example, in a magnetron RIE system at a reaction chamber pressure of 125 mTorr and by using $Cl_2$ as an etching gas. In this case, if a silicon oxide film or silicon nitride film is used as an etching mask, an etching selection ratio can be improved.

Figure 13C:
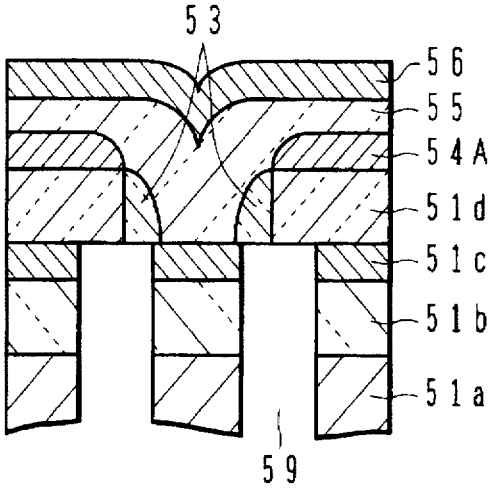
Figure 13B:
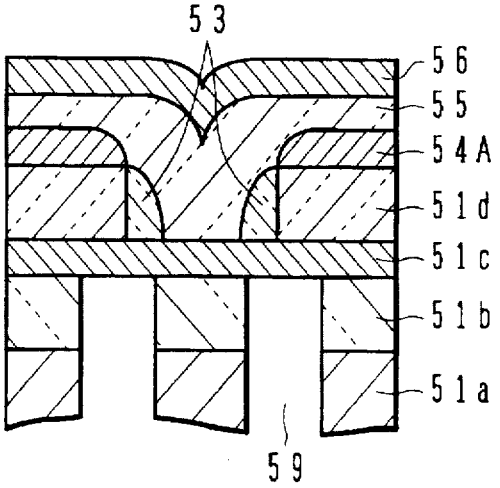

Next, by using the silicon substrate 51*a* as a mask, the silicon oxide film 51*b* is selectively etched (FIG. 13B). This etching is performed, for example, in a magnetron system by using $CHF_3+CO_2+Ar+He$ as an etching gas at a reaction chamber pressure of 50 mTorr. By using the silicon substrate 51*a* and silicon oxide film 51*b* as a mask, the polycrystalline silicon film 51*c* is selectively etched (FIG. 13C). This etching is performed, for example, in a magnetron RIE system by using $Cl_2$ as an etching gas at a reaction chamber pressure of 125 mTorr.

During the etching process of the polycrystalline silicon film 51*c*, the substrate 51*a* is also etched. Since the silicon substrate 51*a* has an initial thickness of, for example, 625 μm and the polycrystalline silicon film 51*c* has an initial thickness of, for example, 0.15 μm, a thickness of 620 μm or thicker of the silicon substrate 51*a* can be maintained.

Figure 13D:
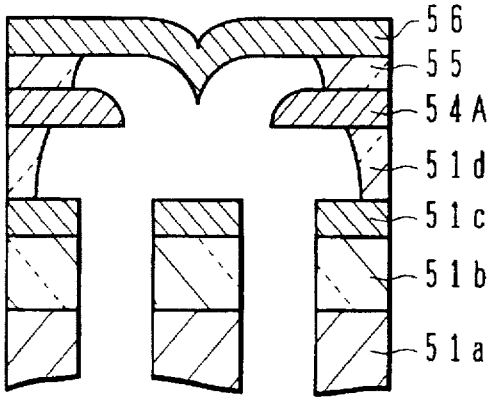

Thereafter, parts of the silicon oxide films 51*d* and 55, and the side spacer 53 are etched by $HF+NH_4$ to form a triode device (FIG. 13D).

Figure 14A:
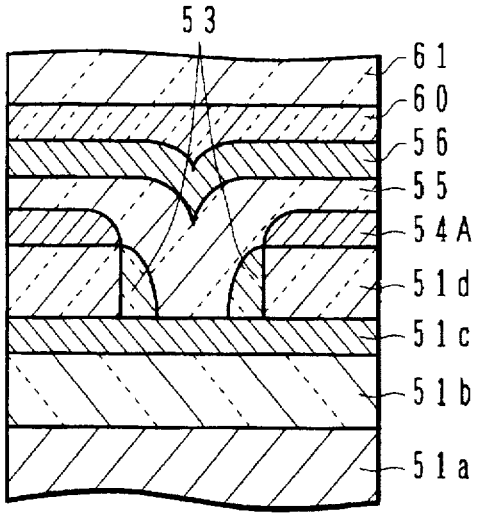
FIGS. 14A to 14C illustrate the processes of manufacturing a field emission type device according to an embodiment of the invention.
Figure 14B:
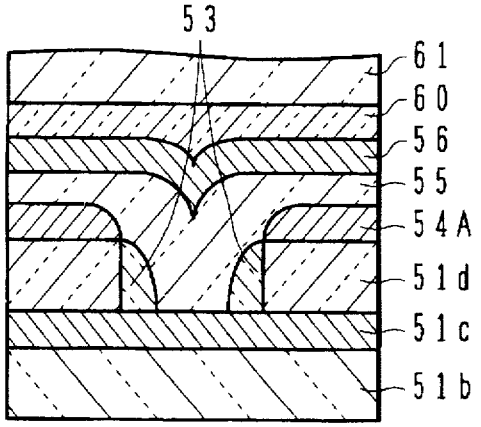
Figure 14C:
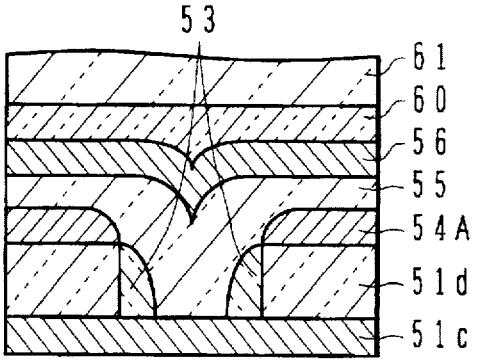

FIGS. 14A to 14C show a modification of the embodiment shown in FIGS. 12A to 12C. Prior to etching from the substrate side, a support substrate 61 made of quartz, glass or the like is adhered by adhesive 60 such as epoxy resin and low melting point glass (FIG. 14A). The silicon substrate 51*a* is etched and removed by using $HF+HNO_3+CH_3COOH$ aqueous solution or ethylenediamine+catechol mixed aqueous solution (FIG. 14B), and the silicon oxide film 51*b* is etched and removed by using $HF+NH_4F$ (FIG. 14C). Next, the similar processes to those shown in FIGS. 12B and 12C are performed to obtain a triode device. A similar modification of the embodiment shown in FIGS. 13A to 13D is also possible.

FIGS. 25A to 25G illustrate another embodiment of a field emission type device having a gate electrode.

Figure 25A:
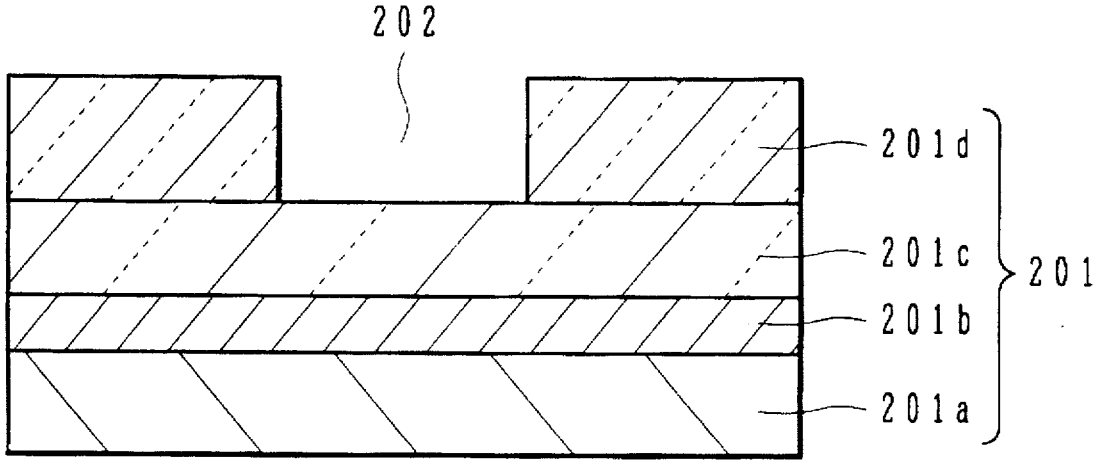
FIGS. 25A to 25G illustrate a method of manufacturing a field emission type device according to another embodiment of the invention.
Figure 25B:
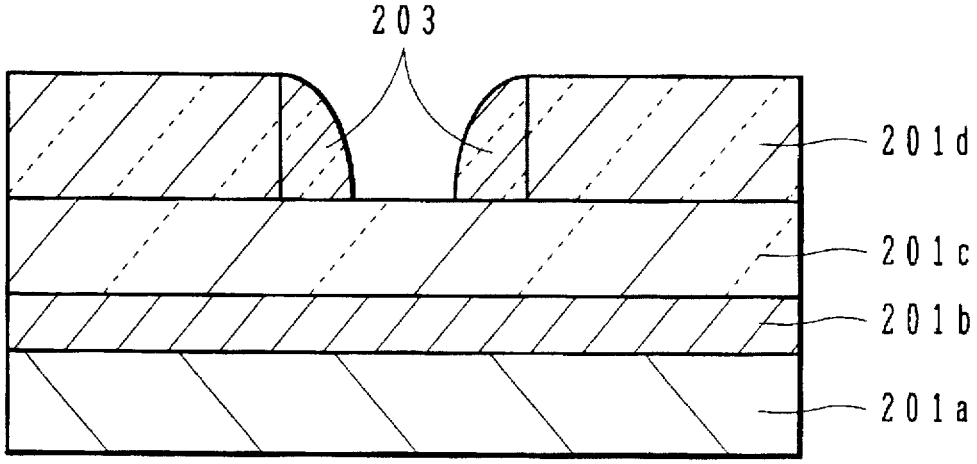

FIG. 25A illustrates a process similar to that of FIG. 5A. A starting substrate 201 is a laminated substrate of a silicon substrate 201*a*, a phosphorous or boron doped polycrystalline silicon film 201*b*, a first sacrificial film 201*c*, and a second sacrificial film 201*d* stacked in this order. The first and second sacrificial films are an insulating film such as a silicon oxide film and a silicon nitride film. A recess 202 is formed by selectively etching the second sacrificial film 201*d*. Thereafter, as shown in FIG. 25B, a side spacer 203 is formed on the side wall of the recess 202. The process of forming the side spacer 203 is the same as that of FIG. 5B.

Figure 25C:
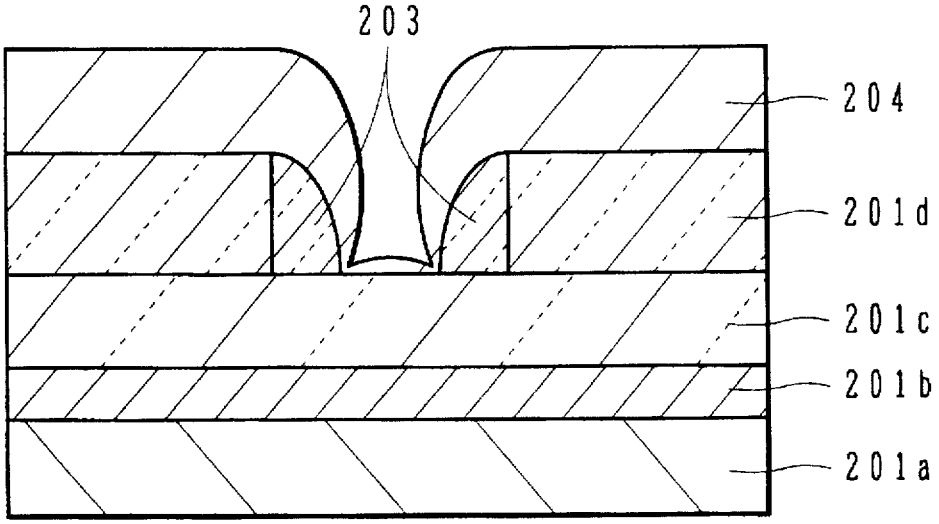

Next, as shown in FIG. 25C, as a gate electrode conductive film 204, a phosphorous or boron doped amorphous silicon film is deposited. In this case, the gate electrode conductive film 204 is deposited under the condition of poorer step coverage than the conductive film 54 shown in FIG. 5C.

Figure 25D:
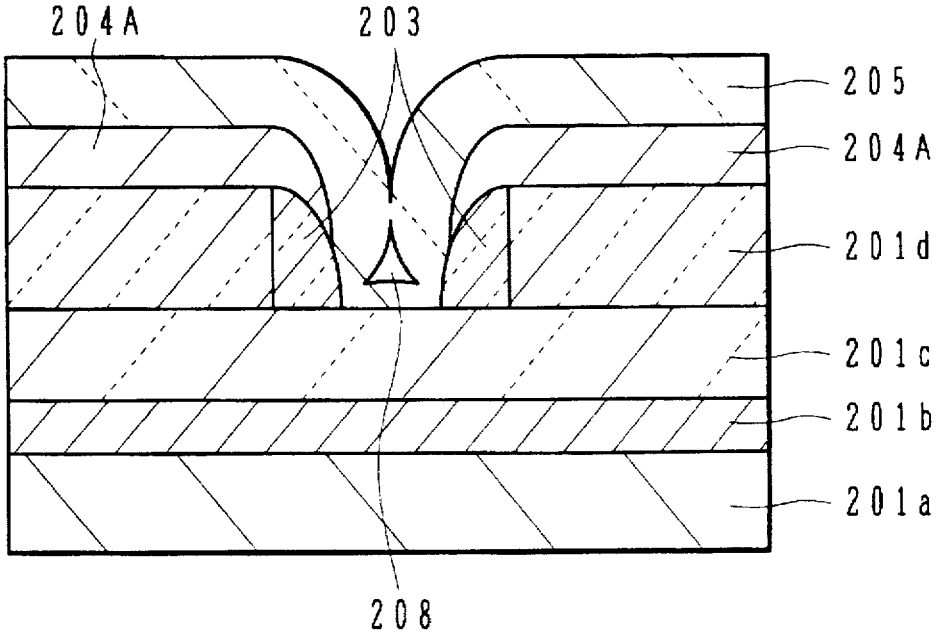

Thereafter, as shown in FIG. 25D, the gate electrode conductive film 204 is partially oxidized through wet oxidation to form a silicon oxide film 205. The unreacted film 204A will serve as a gate electrode. Since the gate electrode conductive film 204 is deposited under the condition of poorer step coverage, a void 208 is formed in the silicon oxide film 205. This void 208 does not adversely affect the device because the lower portion including the void 208 of the silicon oxide film 205 is removed later. The gate electrode conductive film 204 is oxidized under the condition that it is oxidized uniformly from the surface thereof in the depth direction to form the silicon oxide film 205. The region 204A not oxidized is left as the gate electrode. The surface of the silicon oxide film 205 has a downward cusp which is later used as the cathode mold die.

Figure 25E:
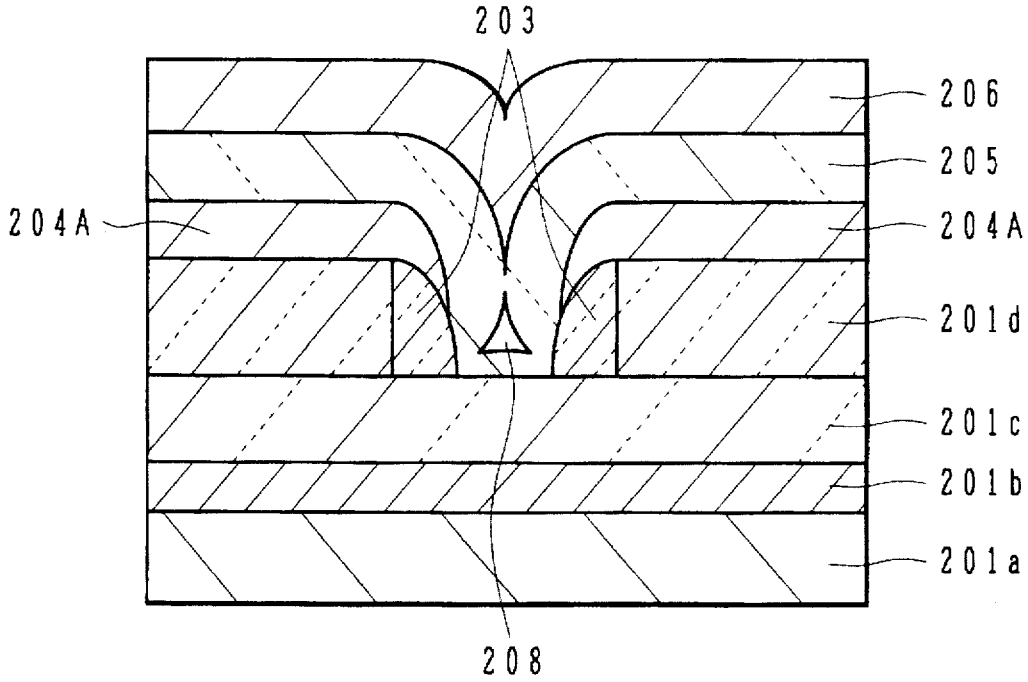
Figure 25F:
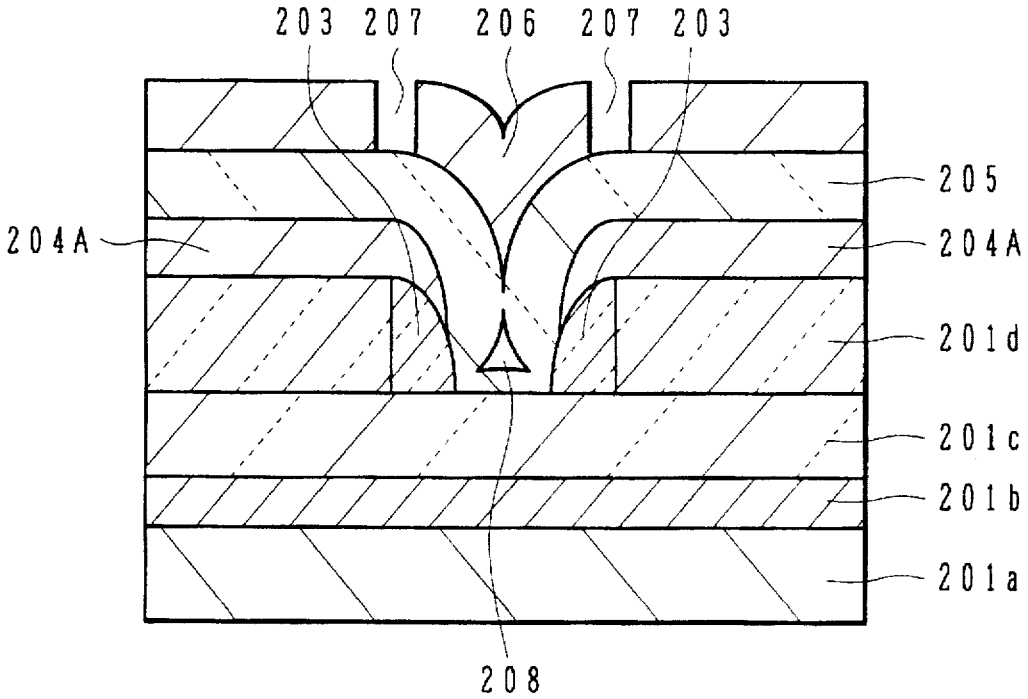
Figure 25G:
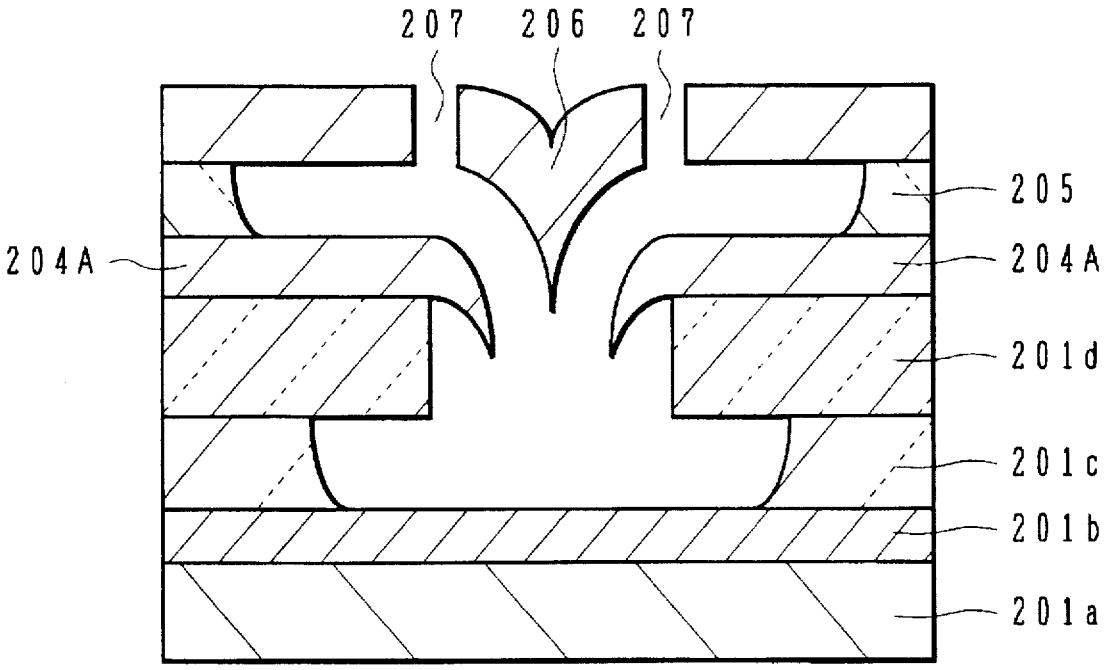

The processes of FIGS. 25E to 25G correspond to those shown in FIGS. 5E to 5G. First, as shown in FIG. 25E, as the cathode conductive film 206, a TiN film is deposited. Next, as shown in FIG. 25F, the portion of the cathode conductive film 206 not used as the cathode is etched and removed to form an opening 207. Then, as shown in FIG. 25G, part of the oxide film 205, side spacer 203, and part of the substrate 201 are etched via the opening 207 and removed to expose the tip of the cathode 206. At this time, part of the silicon oxide film containing the void 208 is also etched and removed. In the above manner, a field emission type device is completed.

In the above embodiments, a single field emission cathode and a field emission type device having one cathode have been described. If a number of recesses used as the cathode mold dies are formed in the substrate, a field emission type device array having a number of cathodes disposed in a matrix form can be manufactured.

A point type cathode formed by a circular recess in plan view or a wedge type cathode formed by a rectangular recess in plan view can also be manufactured. The size of a recess is set depending upon the size of a cathode.

Cathode, gate, and anode electrode conductive films may be made of, in addition to impurity doped silicon, metal silicide such as W silicide and Mo silicide, metals such as W, Mo, Ti, Ta, and Al, or compounds thereof.

Figure 15:
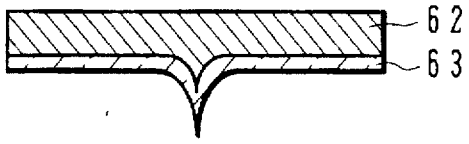
FIG. 15 shows the structure of a field emission cathode of another embodiment.

The field emission cathode structure may be a structure shown in FIG. 15 in which a thin insulating film 63 such as a silicon oxide film is formed on the surface of the cathode 62 on the electron emission side. Instead of the insulating film 63, other materials may be used including high resistance material such as ZnS or ferromagnetic material such as $BaTiO_3$, PZT ($=Pb(Zr_xTi_y)O_3$, where x+y=1), and PZLT ($=(Pb_uLa_v)(Zr_xTi_y)O_3$, where u+v=1 and x+y=1).

Figure 16:
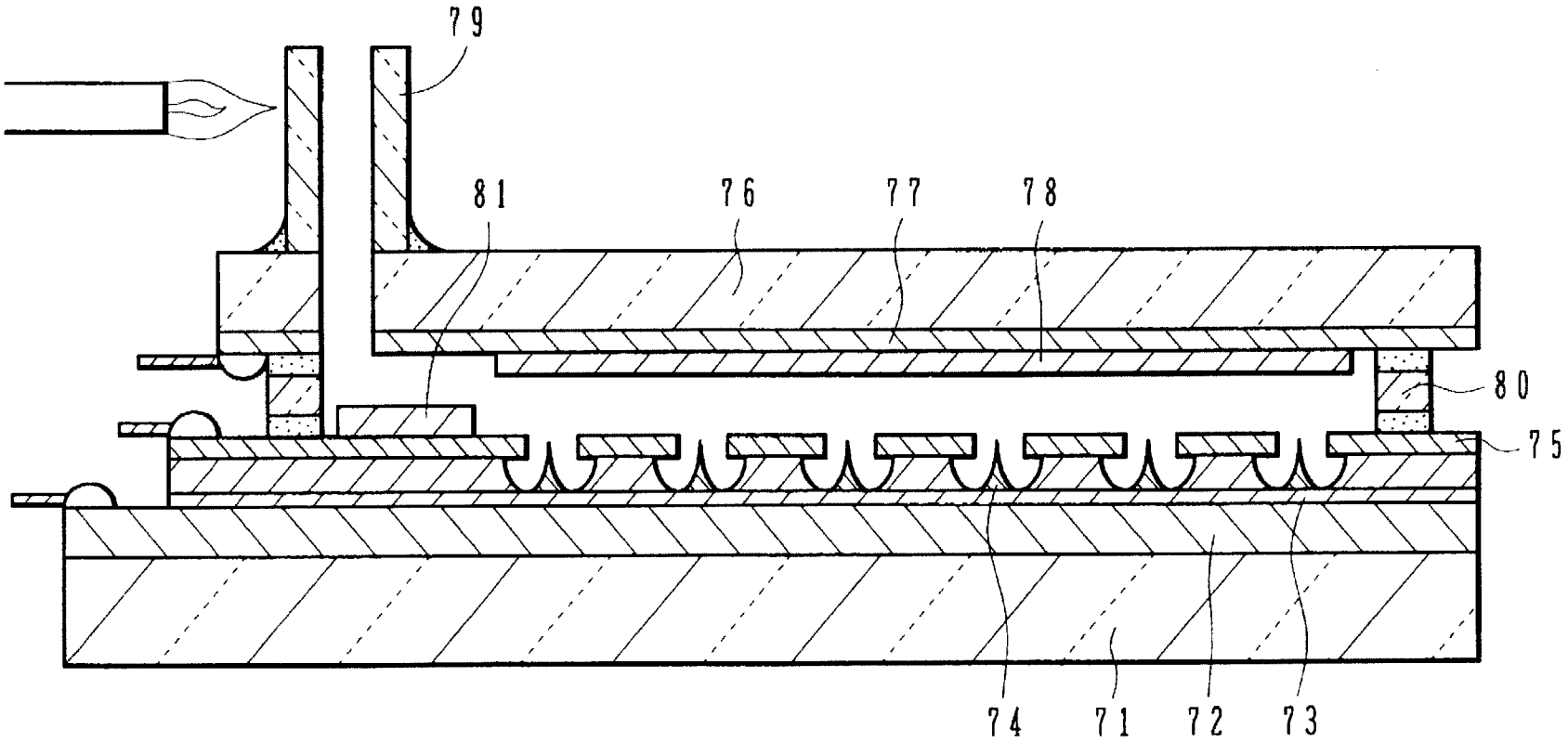
FIG. 16 illustrates an application of a field emission type device to a flat panel display.

FIG. 16 shows a flat panel display which is an example of applications of a field emission type device manufactured by the above embodiments. A field emission type device is used as an electron emitter. On an insulating substrate 71, a conductive film 72 made of Al, Cu, or the like and a resistor film 73 such as polycrystalline silicon are formed in this order. On the resistor film 73, a fine cathode 74 is formed in alignment with the gate hole of a gate electrode 75.

An opposing substrate is disposed facing the field emission cathode array, the opposing substrate having a transparent substrate 76 made of quartz, glass, or the like on which a transparent conductive film 77 made of ITO serving as the anode electrode and a fluorescent film 78 are formed. The gate electrodes 75 are patterned in stripes intersecting at a right angle with the cathode driving conductive film 72 and resistor film 73 in the form of stripes to allow a matrix drive of each pixel. The fluorescent film 78 is also patterned in correspondence with respective pixels. On the cathode array side, a getter 81 made of Ti, Al, Mg, or the like is provided for preventing the generated gas from being attached again to the surface of the cathode 74.

The cathode array and the opposing substrate are adhered together by a spacer 80 made of a glass plate coated with adhesive, with a distance between the transparent conductive film 77 serving as the anode electrode and the cathode 74 being set to 0.1 to 5 mm. The adhesive may be low melting point glass. Instead of a glass plate spacer, another space may be used which is made of adhesive such as epoxy resin containing glass beads dispersed therein.

An exhaust pipe 79 is being connected to the opposing substrate. After the substrate is adhered, the inside of the flat panel display is evacuated via the exhaust pipe 79 to about $10^{-5}$ to $10^{-9}$ Torr. Then, the exhaust port is sealed by using a burner or the like. Thereafter, anode, emitter, and gate electrodes are wired to complete a flat panel display.

Figure 17:
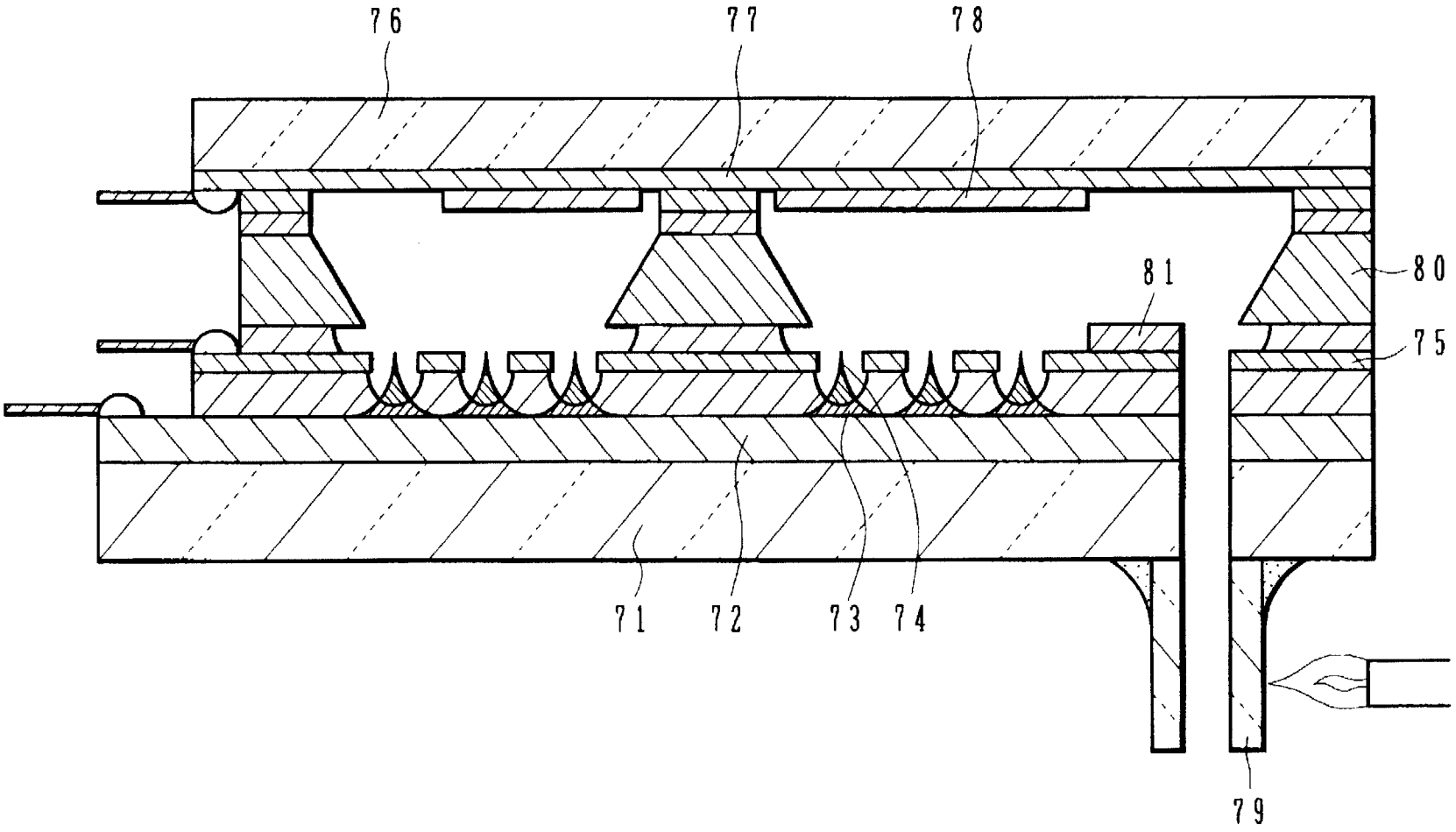
FIG. 17 illustrates another application of a field emission type device to a flat panel display.

FIG. 17 shows another example of the structure of a flat panel display. Like elements to those shown in FIG. 16 are represented by identical reference numerals, and the detailed description thereof is omitted. In this example, an exhaust pipe is provided on the field emission cathode array side. As a spacer 80, a silicon substrate etched to have a desired shape is used.

Figure 18A:
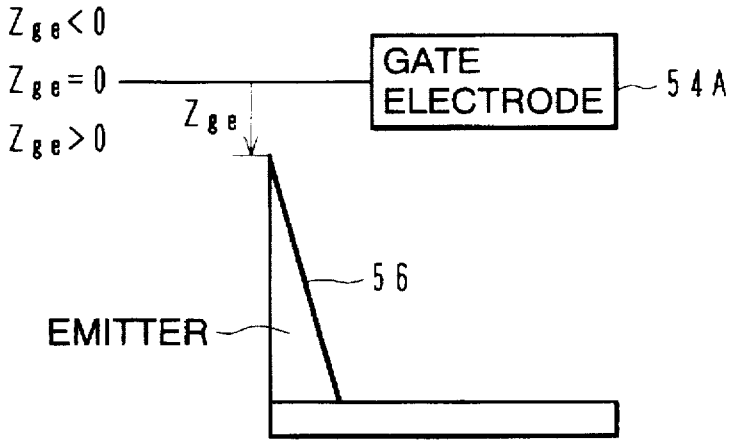
FIGS. 18A and 18B illustrate simulation of a relationship between a distance between a cathode and gate and a maximum electric field intensity.
Figure 18B:
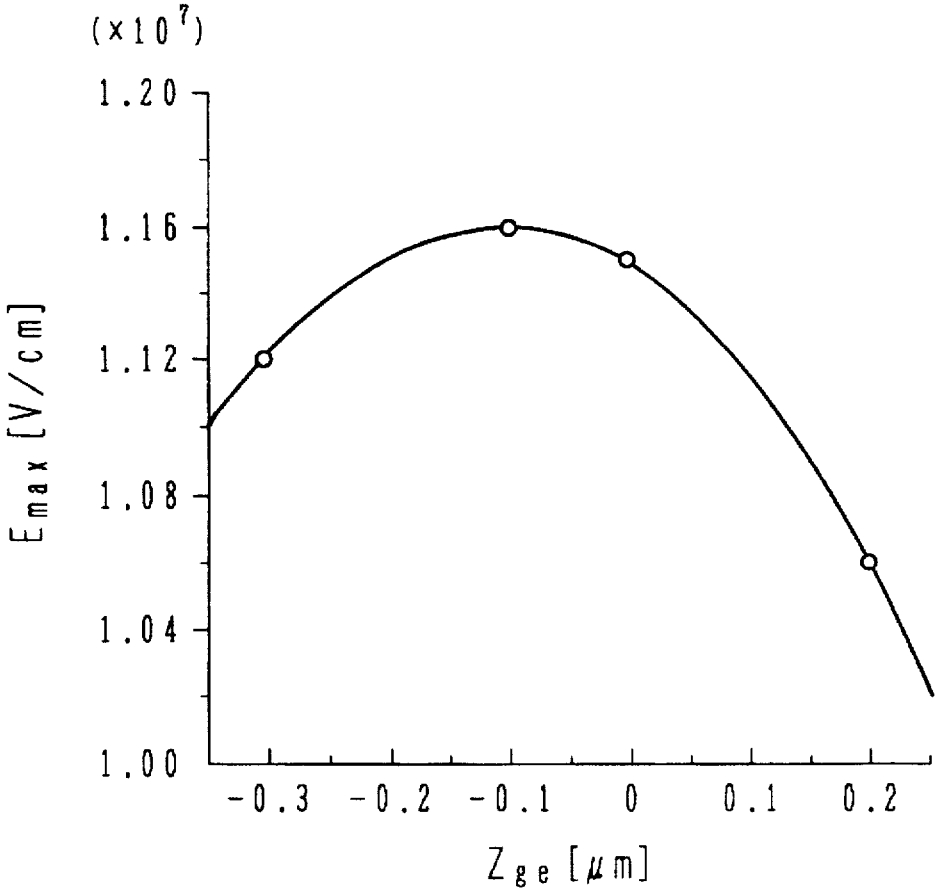
Figure 19A:
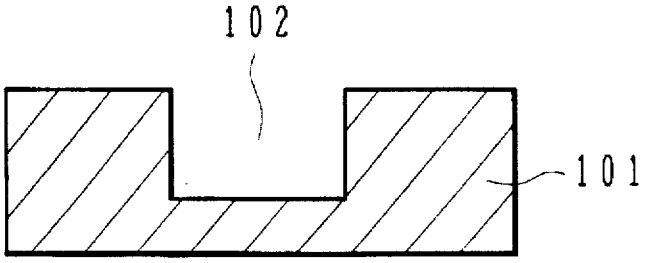
FIG.19A PRIOR ART
FIGS. 19A to 19C illustrate a method of manufacturing a field emission cathode according to conventional techniques.
Figure 19B:
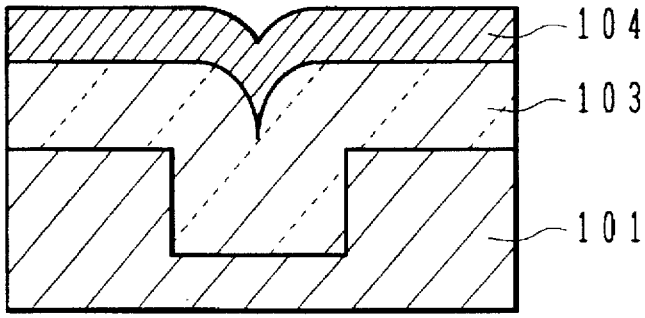
FIG.19B PRIOR ART
Figure 19C:
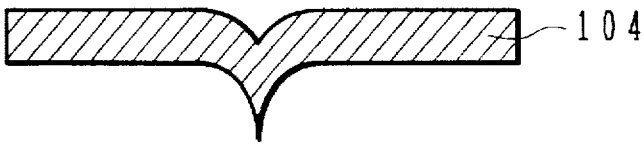
FIG.19C PRIOR ART
Figure 20A:
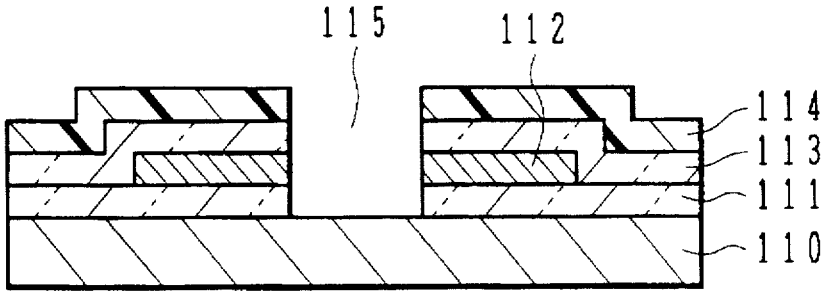
FIG.20A PRIOR ART
FIGS. 20A to 20E illustrate another method of manufacturing a field emission cathode according to conventional techniques.
Figure 20B:
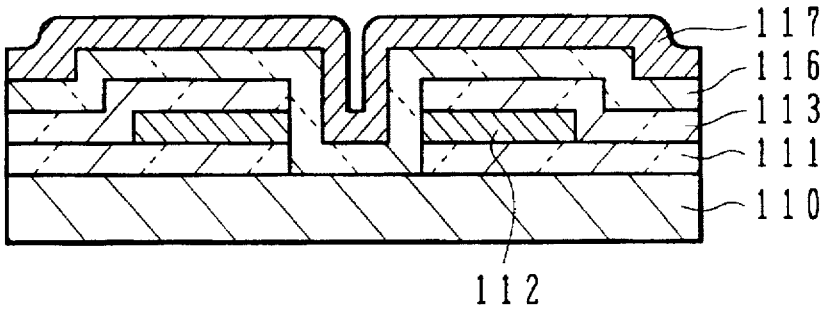
FIG.20B PRIOR ART
Figure 20C:
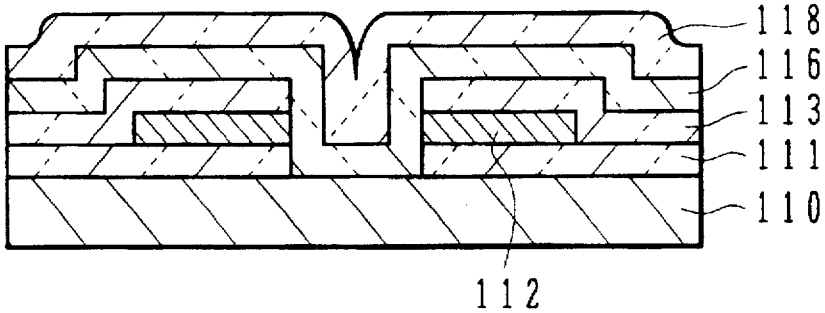
FIG.20C PRIOR ART
Figure 20D:
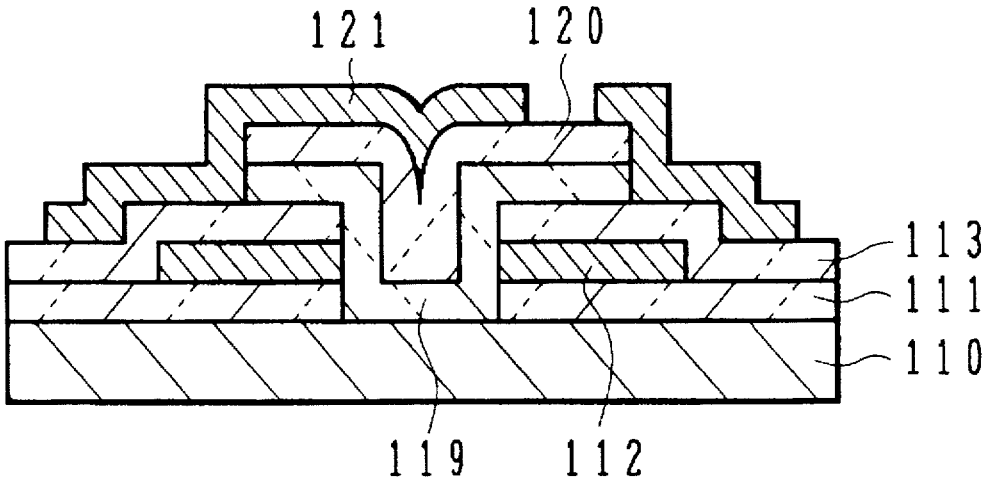
FIG.20D PRIOR ART
Figure 20E:
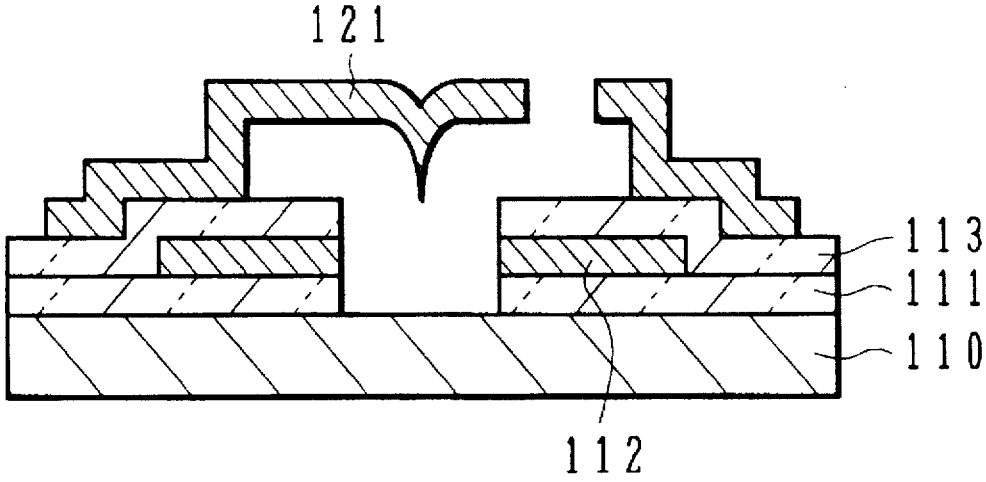
FIG.20E PRIOR ART
Figure 21A:
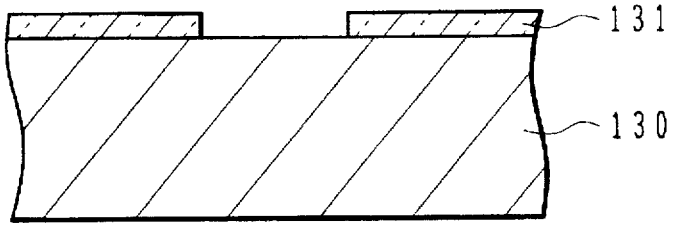
FIG.21A PRIOR ART
FIGS. 21A to 21D illustrate another method of manufacturing a field emission cathode according to conventional techniques.
Figure 21B:
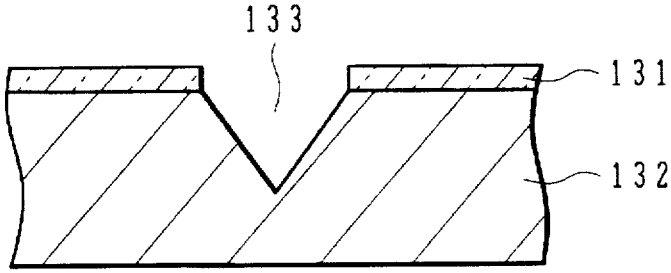
FIG.21B PRIOR ART
Figure 21C:
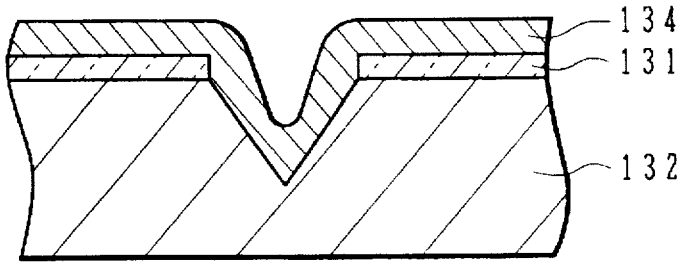
FIG.21C PRIOR ART
Figure 21D:
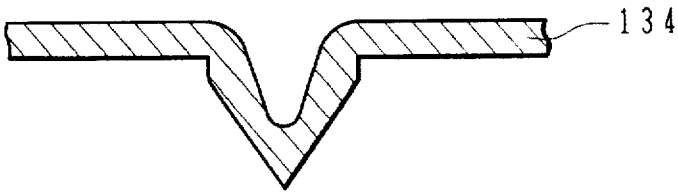
FIG.21D PRIOR ART
Figure 22A:
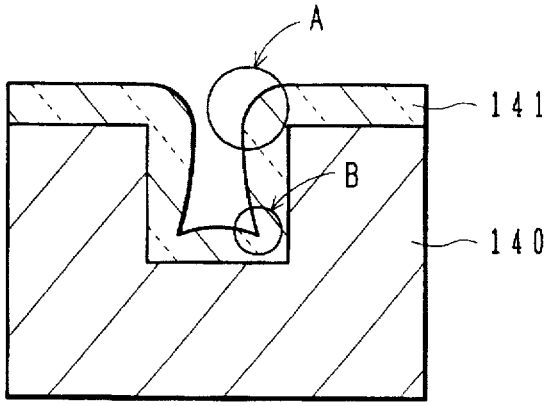
FIG.22A PRIOR ART
FIGS. 22A to 22C are diagrams used for explaining problems associated with conventional techniques.
Figure 22B:
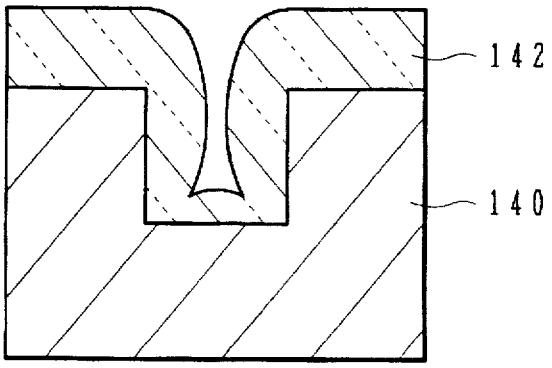
FIG.22B PRIOR ART
Figure 22C:
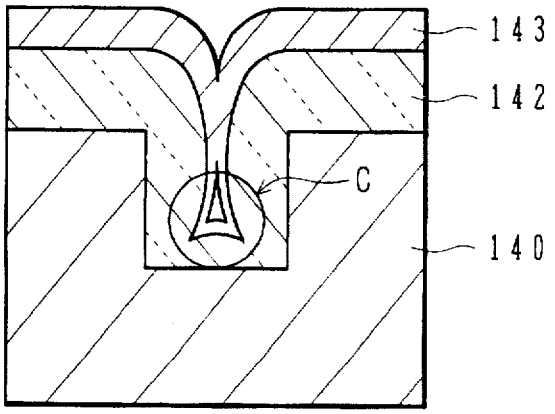
FIG.22C PRIOR ART
Figure 23A:
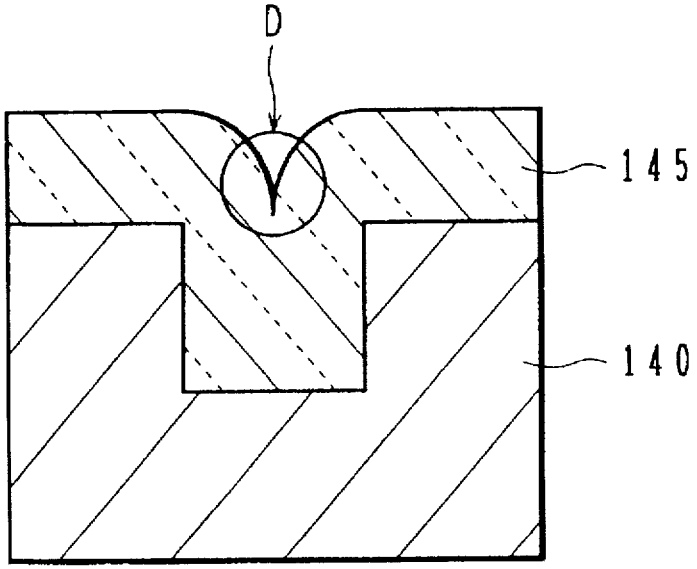
FIG.23A PRIOR ART
FIGS. 23A and 23B are diagrams used for explaining problems associated with conventional techniques.
Figure 23B:
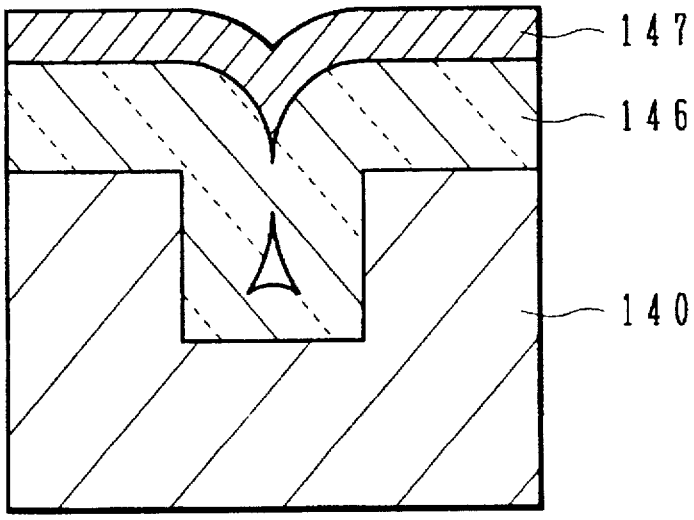
FIG.23B PRIOR ART
Figure 24A:
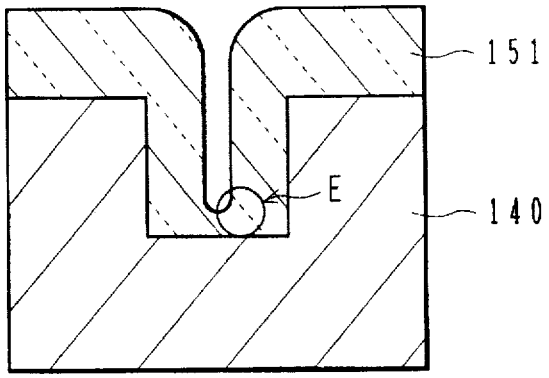
FIG.24A PRIOR ART
FIGS. 24A to 24C are diagrams used for explaining problems associated with conventional techniques.
Figure 24B:
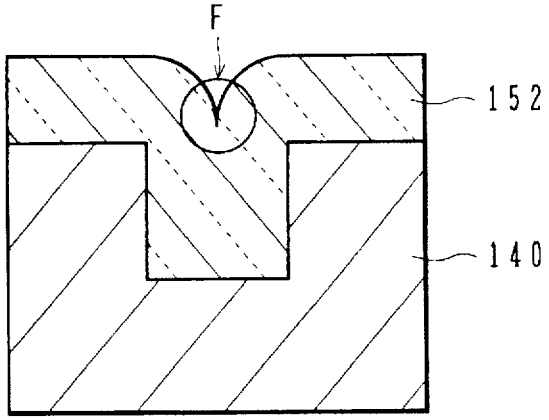
FIG.24B PRIOR ART
Figure 24C:
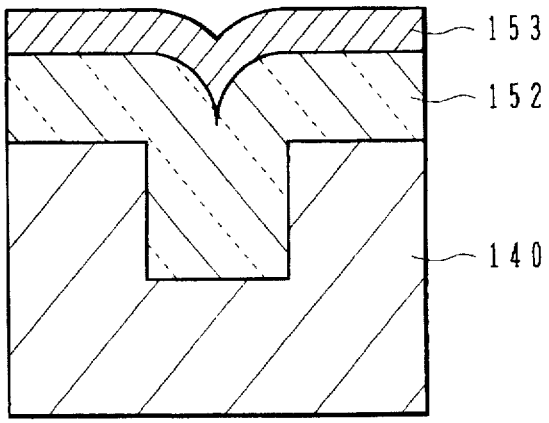
FIG.24C PRIOR ART

FIGS. 18A and 18B illustrate simulation of a relationship between a distance between a cathode and gate and a maximum electric field intensity, for evaluating the operations of the above embodiments.

In FIG. 18A, a relative distance between a gate electrode 54A and the tip of an emitter (cathode) electrode 56 is represented by Zge, along the direction of emitting electrons from the tip.

FIG. 18B shows simulation results of a maximum electric field intensity Emax at the tip of the cathode 56 and at the distance Zge in the range from −0.85 μm to 0.25 μm. As seen from FIG. 18B, the maximum electric field intensity depends largely on the distance Zge. Emax takes an extreme value of $1.16\times10^7$ V/cm at Zge=−0.1 μm. Therefore, the tip of the cathode 56 is optimal if it positions slightly higher as viewed in FIG. 18A than the center of the gate electrode 54A.

With the embodiment methods, the cathode mold die is formed by a combination of a side spacer and a process of oxidizing or nitriding. Therefore, the distance between the tip of a cathode and the gate electrode is easy to control and a maximum electric field intensity can be obtained easily.

The present invention has been described in connection with the preferred embodiments. The invention is not limited only to the above embodiments. It is apparent to those skilled in the art that various modifications, improvements, combinations and the like can be made without departing from the scope of the appended claims.

I claim:

1. A method of manufacturing a field emission cathode, comprising the steps of:

forming a recess having a vertical or generally a vertical side wall in a substrate;

depositing a first sacrificial film on the substrate, including within the recess;

forming a side spacer in the recess by etching the first sacrificial film;

depositing a second sacrificial film on the substrate, including in the recess having the side spacer;

forming an oxide film or nitride film by oxidizing or nitriding the second sacrificial film;

depositing a field emission cathode electrode material film on the oxide film or nitride film; and removing at least part of the oxide film or nitride film under the field emission cathode electrode material film to expose at least a tip of the field emission cathode electrode material film.

2. A method according to claim 1, further comprising a step of fixing the field emission cathode electrode material film to a support substrate.

3. A method according to claim 1, wherein the substrate has a laminate structure of a first layer and a second layer, and said step of forming a recess in a substrate forms a recess by selectively etching only the second layer.

4. A method according to claim 1, wherein said step of depositing a second sacrificial film forms a non-conformal film.

5. A method according to claim 4, wherein said step of forming an oxide film or nitride film oxidizes or nitrides the second sacrificial film to a full depth at the bottom area of the recess.

6. A method according to claim 4, wherein said step of depositing a second sacrificial film includes etching back a non-conformal film.

7. A method of manufacturing a field emission type device, comprising the steps of:

forming a recess having a vertical or generally a vertical side wall in a substrate;

depositing a sacrificial film on the substract, including within the recess;

forming a side spacer in the recess by etching the sacrificial film;

depositing a gate electrode conductive film on the substrate having the recess with the side spacer;

forming an oxide film or nitride film by oxidizing or nitriding the surface of the conductive film;

depositing a field emission cathode electrode material film on the oxide film or nitride film; and removing the oxide film or nitride film around a tip of the field emission cathode electrode material film to expose the tip thereof.

8. A method according to claim 7, wherein the substrate has a laminate structure of a first layer and a second layer, and said step of forming a recess in a substrate is per formed by selectively etching only the second layer.

9. A method according to claim 7, wherein said step of depositing the conductive film forms a non-conformal film.

10. A method according to claim 9, wherein said step of forming an oxide film or nitride film oxidizes or nitrides the conductive film to a full depth at the bottom area of the recess.

11. A method according to claim 9, wherein said step of depositing a conductive film includes etching back a non-conformal film.

* * * * *